US007980557B2

(12) United States Patent
Seki et al.

(10) Patent No.: US 7,980,557 B2
(45) Date of Patent: Jul. 19, 2011

(54) DOCUMENT HANDLER CAPABLE OF PROTECTING A BUILT-IN SENSOR FROM EXTRANEOUS SUBSTANCE

(75) Inventors: Toru Seki, Kanagawa (JP); Nobuo Takashima, Kanagawa (JP)

(73) Assignee: Japan Cash Machine Co., Ltd., Osaka (JP)

( * ) Notice: Subject to any disclaimer, the term of this patent is extended or adjusted under 35 U.S.C. 154(b) by 289 days.

(21) Appl. No.: 12/413,989

(22) Filed: Mar. 30, 2009

(65) Prior Publication Data

US 2009/0302529 A1 Dec. 10, 2009

(30) Foreign Application Priority Data

Jun. 9, 2008 (JP) ..... 2008-151043

(51) Int. Cl.
*B65H 5/00* (2006.01)

(52) U.S. Cl. ..... 271/264; 271/258.01; 271/265.01

(58) Field of Classification Search ..... 271/264, 271/258.01, 265.01; 194/205, 206
See application file for complete search history.

(56) References Cited

U.S. PATENT DOCUMENTS 5,462,150 A * 10/1995 Chang ..... 194/206
5,632,367 A * 5/1997 Bergeron et al. ..... 194/207
2010/0116618 A1* 5/2010 Arifon ..... 194/206

* cited by examiner

*Primary Examiner* — David H Bollinger
(74) *Attorney, Agent, or Firm* — Bachman & LaPointe, P.C.

(57) ABSTRACT

A document handler is provided with a casement 1 which comprises a lower case 6 which has a lower cover 7 for providing a bottom surface of a passageway 5 and a lower tray 8 attached to a bottom of lower cover 7 to form therebetween a lower cavity 3*d* in which lower optical sensing element 3*a* of optical sensor 3 is disposed. Even if liquid spilled on a main surface of the table may often enter passageway 5 to the rear from the bill inlet, there is incurred no damage to electric instruments in lower cavity 3*d* by extraneous substance which is discharged through a drainage 15.

23 Claims, 29 Drawing Sheets

DOCUMENT HANDLER CAPABLE OF PROTECTING A BUILT-IN SENSOR FROM EXTRANEOUS SUBSTANCE

TECHNICAL FIELD

This invention relates to a document handler, in particular, of the type capable of protecting a built-in sensor from extraneous substance such as dust, dirt, liquid or the like intruding from outside.

BACKGROUND OF THE INVENTION

Typical document handlers include bill or document validators as document handling machines which are mounted in vending machines, money changers, automatic teller machines, automatic cash dispensers and gaming machines. A usual document validator comprises a conveyer for transporting a document along a passageway, an optical sensor for detecting physical features of the document moving along the passageway to produce detection signals, and a controller for receiving detection signals from the optical sensor to control operation of the conveyer. A document validator of this type is disclosed by for example U.S. Pat. No. 5,632,367 to Alfred F. Bergeron et al.

The optical sensor is typically attached in the vicinity or inside of a document inlet along the passageway, and therefore, is subject to danger of being exposed to extraneous object intruding from outside through document inlet, that may cause operational malfunction or deterioration in electric property of the sensor. Prior art document validators, however, cannot effectively bar or avert ingress of foreign matter into built-in electric instruments.

An object of the present invention is to provide a document handler that has built-in electric/electronic instruments hermetically sealed in a water-proof structure immune to extraneous substance such as liquid or dust entering a passageway of the document handler. Another object of the present invention is to provide a document handler that can prevent electrical and mechanical damage to built-in electric instruments caused by intruding extraneous substance. Still another object of the present invention is to provide a document handler capable of effectively expelling outside extraneous objects that come into a passageway of document handler.

SUMMARY OF THE INVENTION

The document handler according to the present invention comprises: a casement (1) for defining a passageway (5), a conveyer (2) for transporting a document along passageway (5), an optical sensor (3) having a lower optical sensing element (3*a*) for detecting physical features of document moving along passageway (5) to produce detection signals, and a controller for receiving detection signals from optical sensor (3) to control operation of the conveyer (2). Casement (1) comprises a lower case (6) which has a lower cover (7) and a lower tray (8) attached to a bottom of lower cover (7) to form a lower cavity (3*d*) between lower cover (7) and lower tray (8). Lower cover (7) is formed of a light-permeable and water-shedding plastic material for providing a bottom surface of passageway (5). Lower optical sensing element (3*a*) of optical sensor (3) is disposed within lower cavity (3*d*). In other words, lower cover (7) and lower tray (8) make up a shield structure for protecting lower optical sensing element (3*a*) from being damaged by penetrating extraneous substance or applied mechanical force. In addition thereto, lower optical sensing element (3*a*) can emit or receive a light through lower cover (7) to detect physical features of the document.

Some of gaming or gambling machines have a table provided with a document or bill handler obliquely embedded in the table such that a bill inlet of bill handler is flush with a main surface of the table, and an operator can insert a bill into the bill inlet to stow it in the bill handler. However, liquid spilled on the main surface of the table may often enter passageway (5) to the rear from the bill inlet. In this case, there is incurred no damage to electric instruments in the document handler according to the present invention because lower optical sensing element (3*a*) of optical sensor (3) is safely disposed in lower cavity (3*d*) formed between lower cover (7) and lower tray (8) to block liquid from entering lower cavity (3*d*) by a shield structure of lower cover (7) and lower tray (8). Also, trial light radiated from lower optical sensing element (3*a*) passes through light-transmitting lower cover (7) and is irradiated on a document, and then part of trial light reflected on the document again passes through lower cover (7) and is received by lower optical sensing element (3*a*). Otherwise, another part of trial light permeates the document and then is received by upper optical sensing element (3*b*) so that trial light received by lower and upper optical sensing elements (3*a*, 3*b*) may be used to easily detect optical features of the document. Extraneous substance coming into passageway (5) from an inlet (5*c*) travels by its own gravity or by any kinetic force through openings (13) or drainage (15) and interior of lower case (6), and is exhausted from a discharge port (15*a*) formed at the rear portion of lower case (6) to prevent accumulation of harmful extraneous substance in lower case (6).

Thus, the instant invention can deter occurrence of malfunction and breakdown of the document handler because lower cover is made of a water-shedding plastic material, and also, lower optical sensing element is hermetically sealed in lower cavity enveloped between lower cover and lower tray to evade damage to lower optical sensing element by foreign substance intruding into the passageway.

BRIEF DESCRIPTION OF THE DRAWINGS

The above-mentioned and other objects and advantages of the present invention will be apparent from the following description in connection with preferred embodiments shown in the accompanying drawings wherein.

BEST MODE FOR CARRYING OUT THE INVENTION

Embodiments of the document handler according to the present invention will be described hereinafter in connection with FIGS. 1 to 50 of drawings wherein the document handler is applied to a bill validator.

Figure 44:
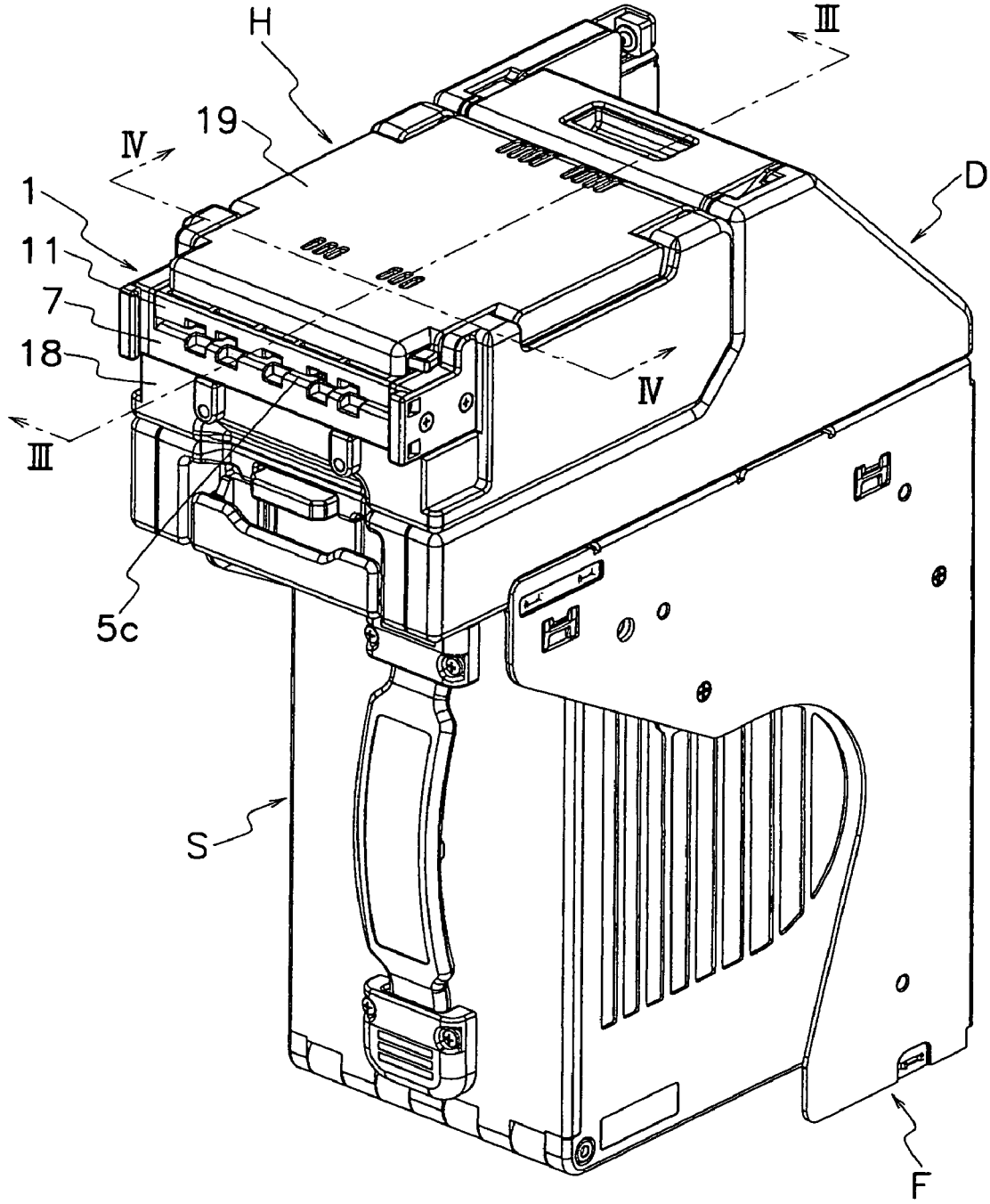
FIG. 44 is a perspective view showing the document handler according to the present invention.
Figure 45:
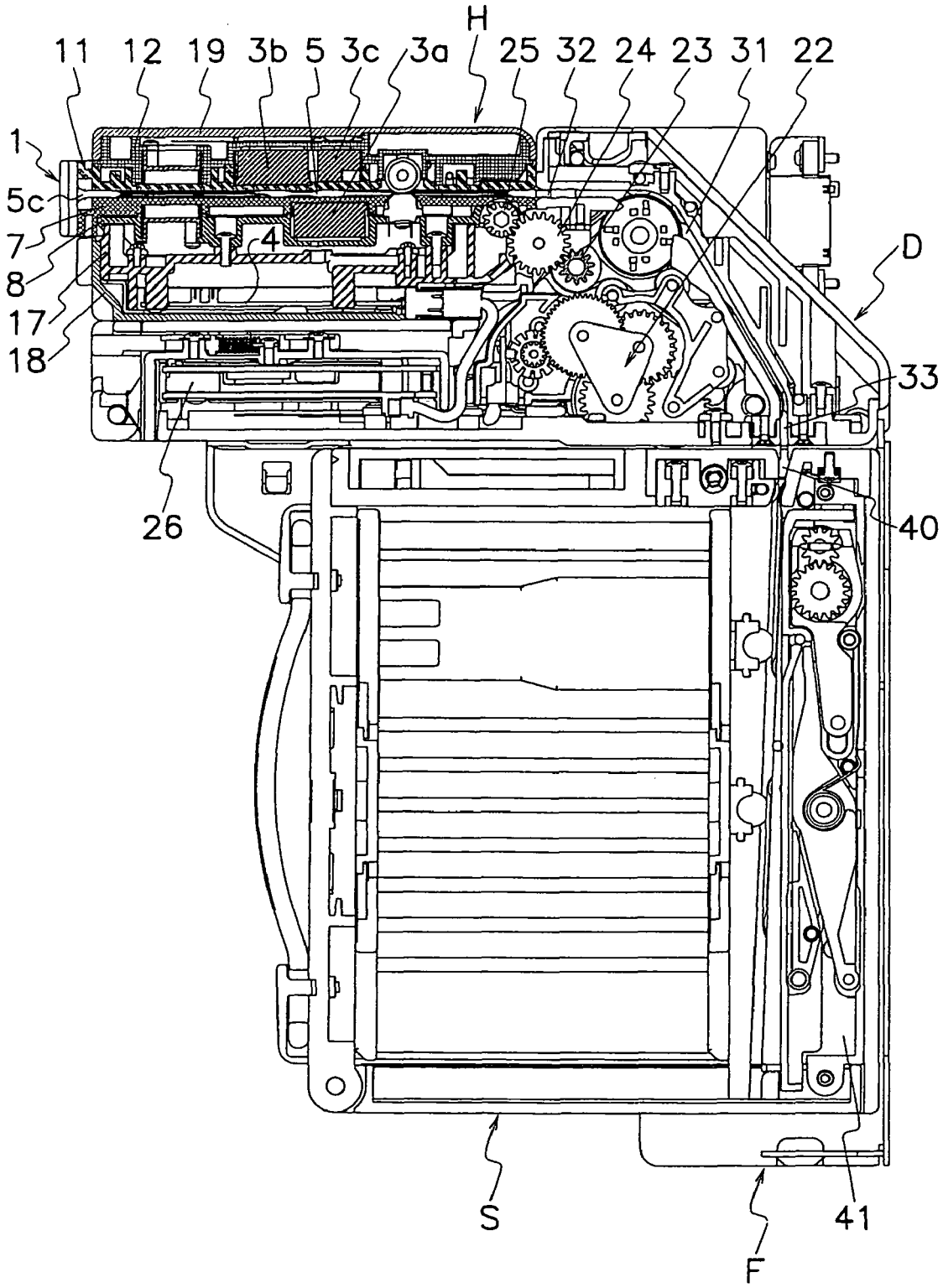
FIG. 45 is a sectional view of the document handler in FIG. 44.
Figure 46:
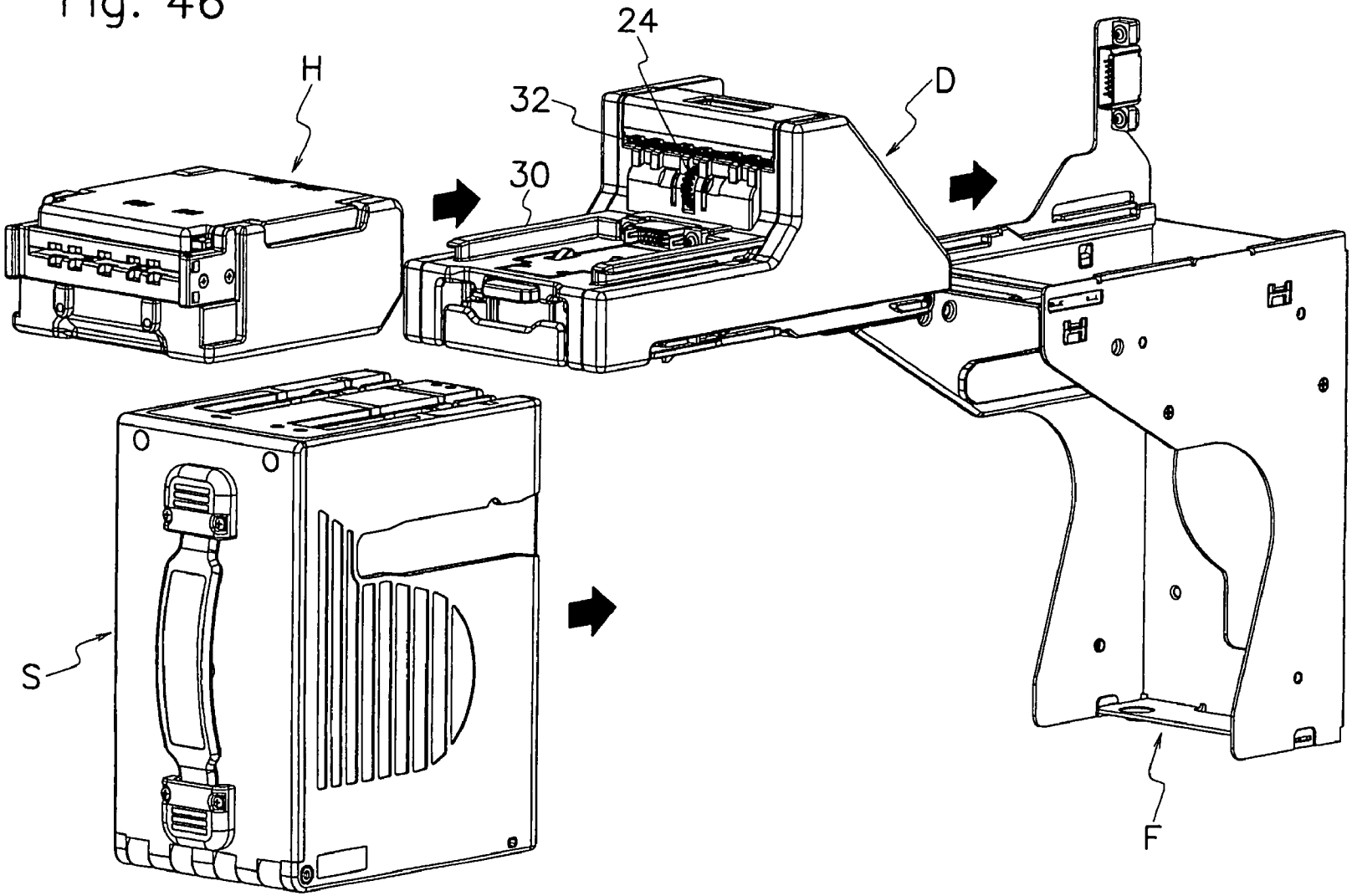
FIG. 46 is a perspective view of the document handler during assemblage.
Figure 47:
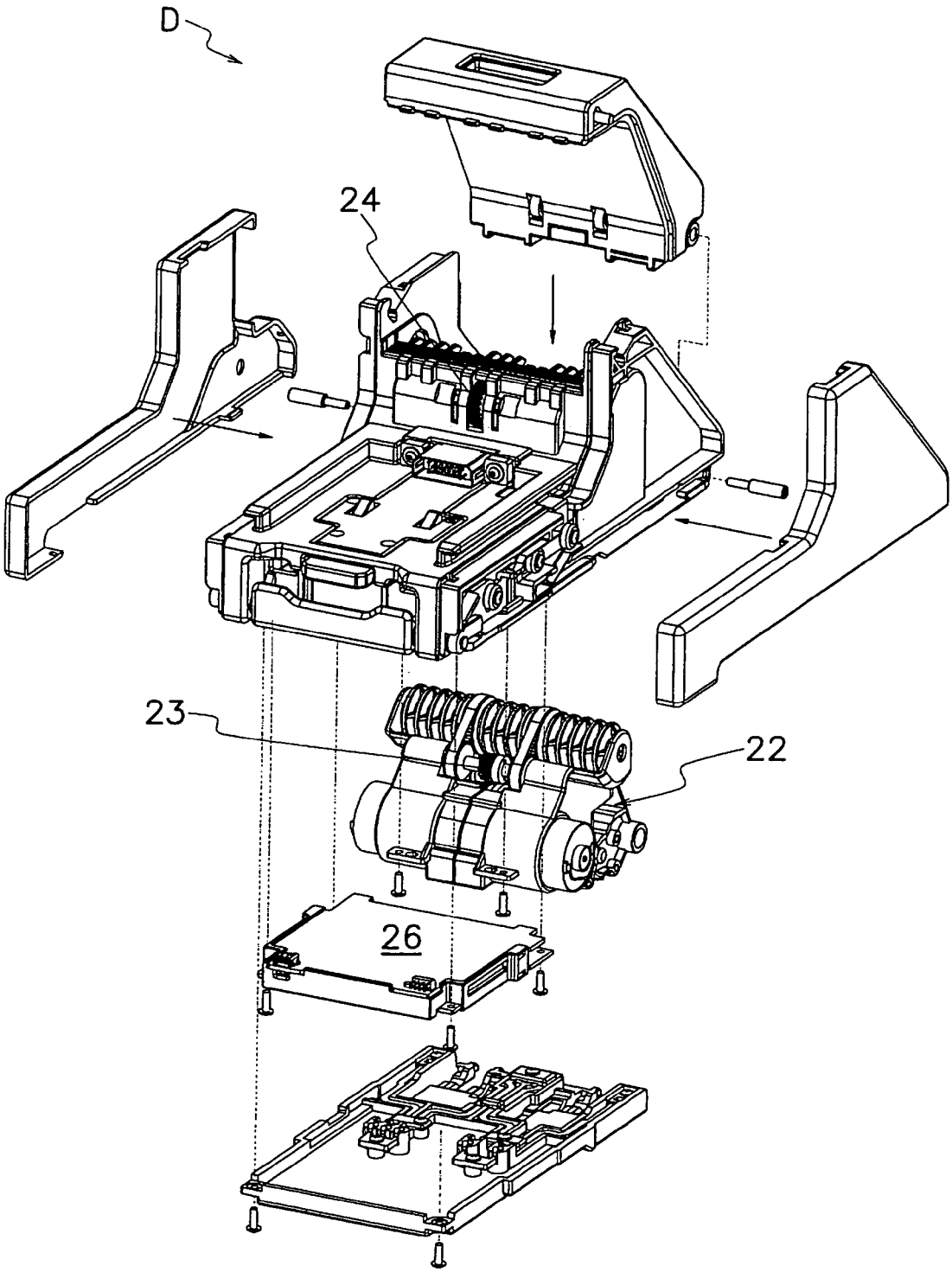
FIG. 47 is an exploded perspective view of a conveyer unit.
Figure 48:
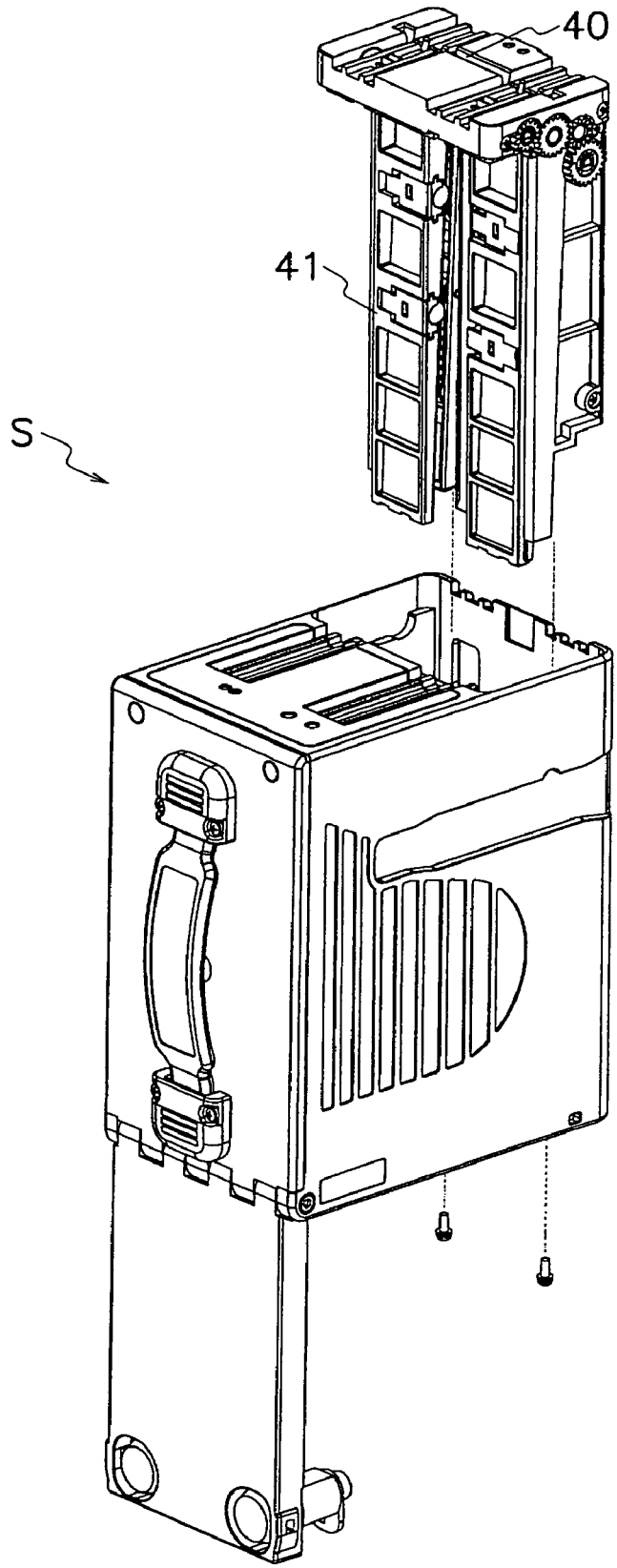
FIG. 48 is a perspective view of a stacker unit.
Figure 49:
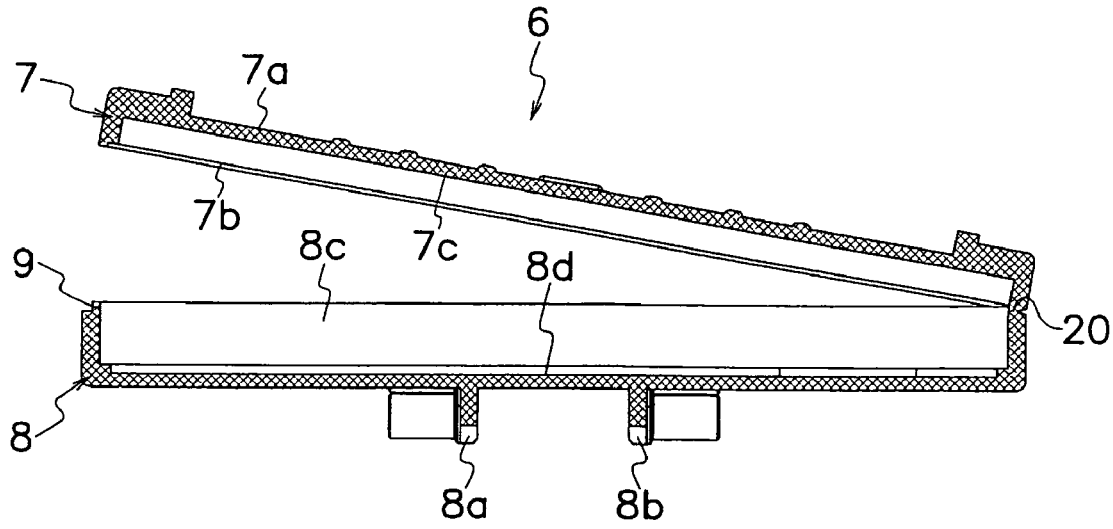
FIG. 49 is a sectional view showing another embodiment of the lower case.

An embodiment of the bill validator according to the present invention is shown in FIGS. 44 to 46, which comprises a conveyer unit D, a discrimination unit H removably attached to conveyer unit D, a main frame F removably attached to conveyer unit D to support it, and a stacker unit S removably attached to main frame F. As shown in FIG. 46, discrimination unit H can be detached from conveyer unit D which can also be detached from main frame F, and likewise, stacker unit S can be detached from main frame F. As illustrated in FIG. 48, a bill stacking mechanism 41 having a bill entrance 40 can be installed in stacker unit S.

Figure 1:
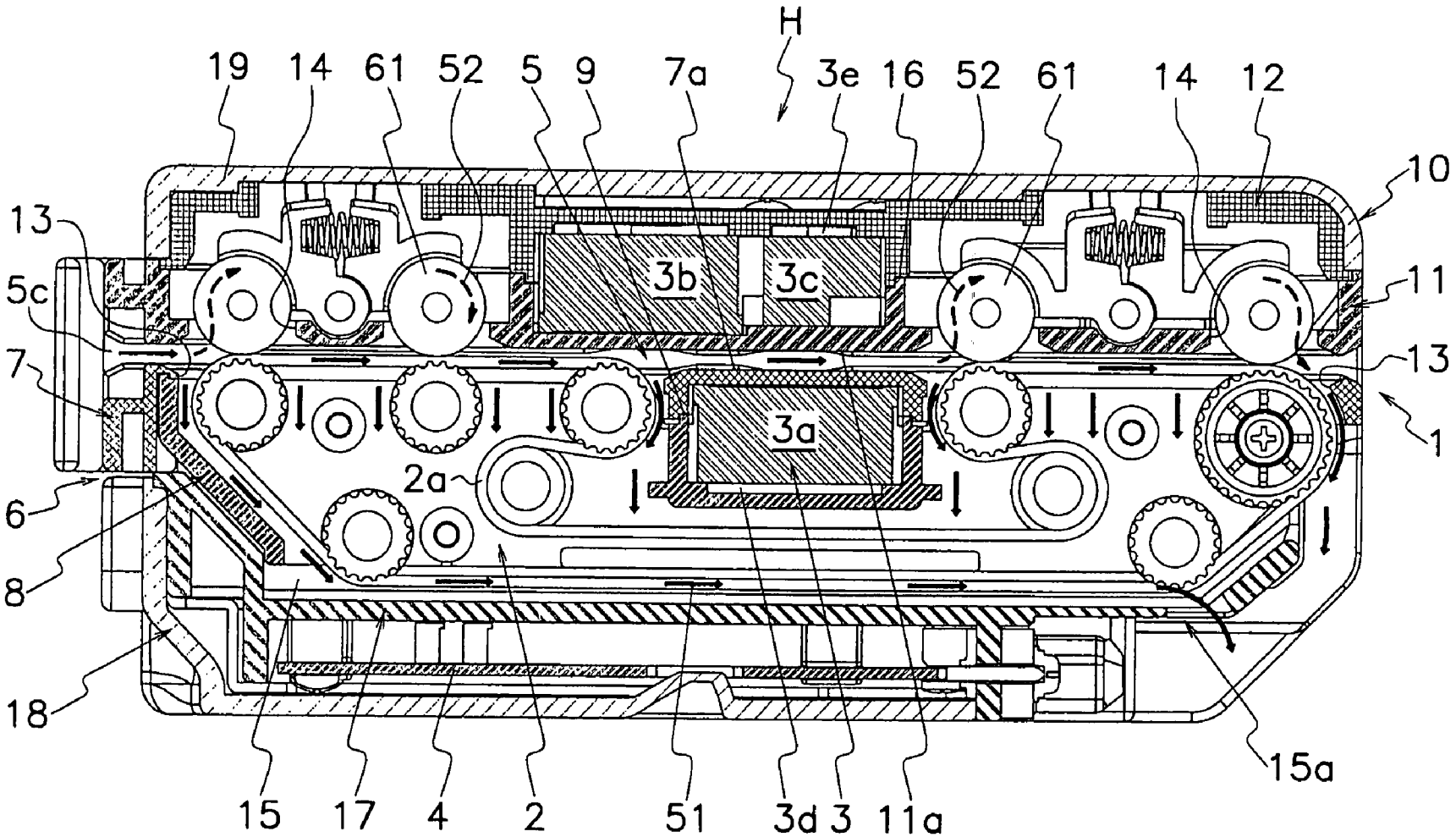
FIG. 1 is a longitudinally sectional view of the document handler according to the present invention.
Figure 4:
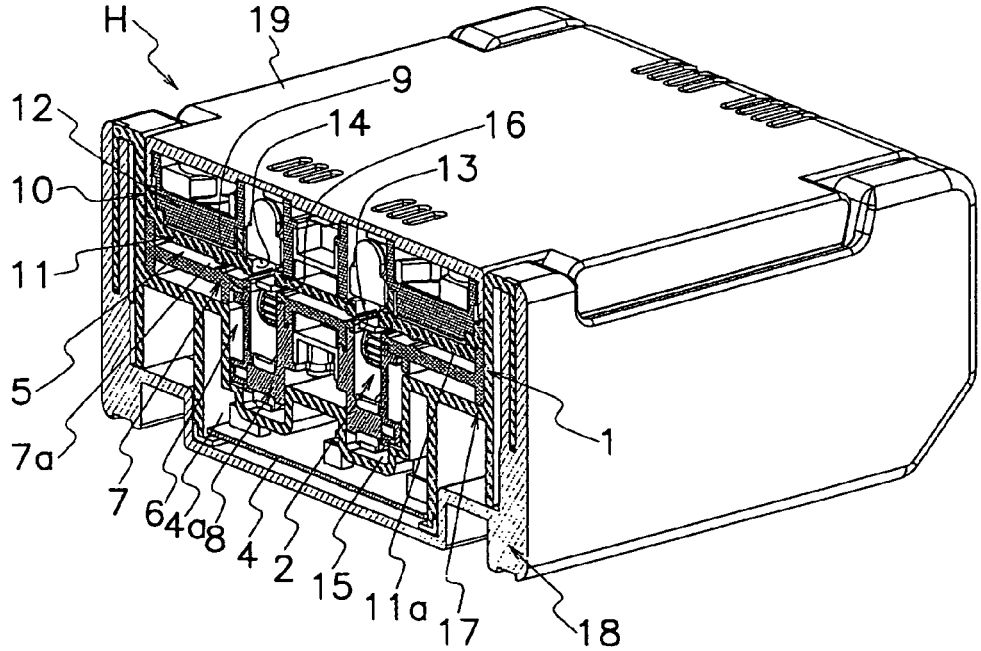
FIG. 4 is a sectional view taken along a line IV-IV of the discrimination unit shown in FIG. 44.
Figure 5:
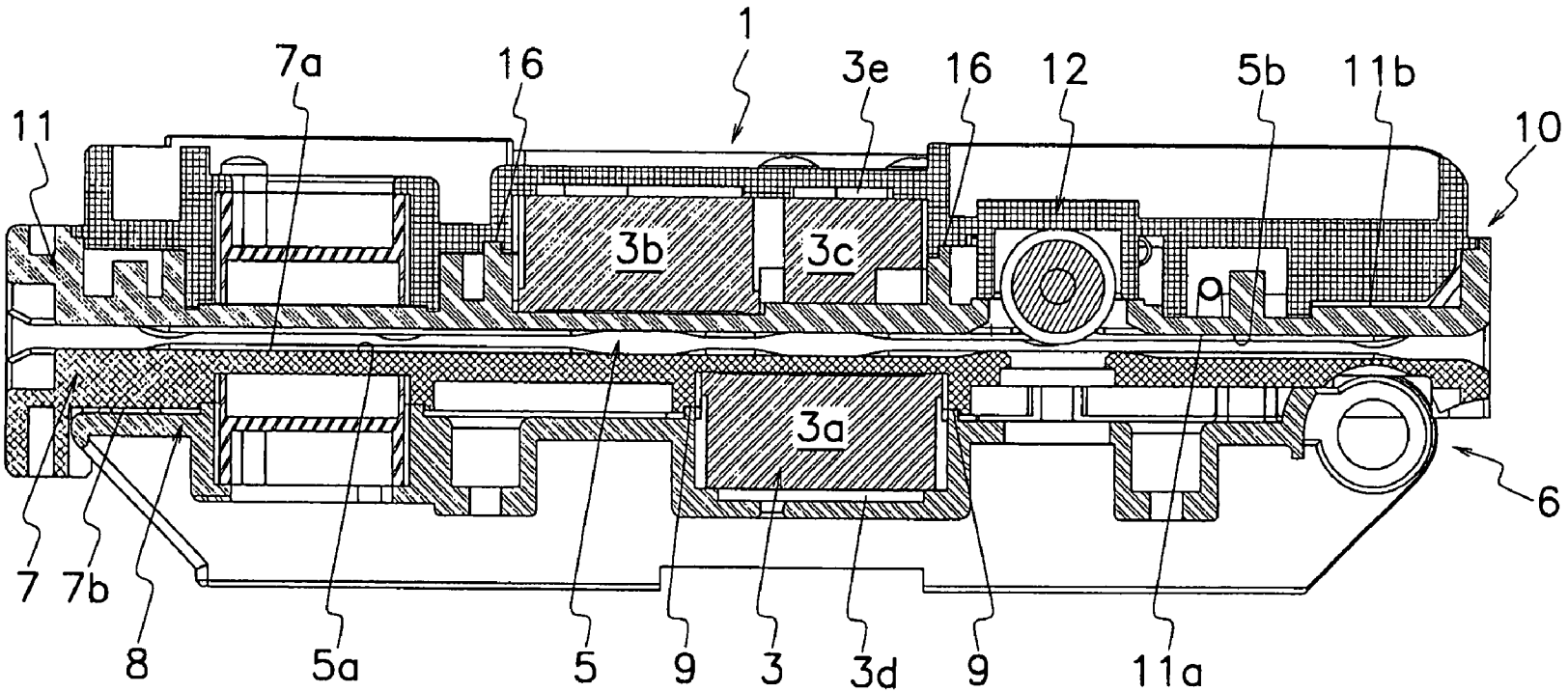
FIG. 5 is a longitudinally sectional view of a casement.

As understood from FIGS. 1, 4 and 45, discrimination unit H comprises a casement 1 for defining a passageway 5, a conveyer 2 for transporting a document or bill along passageway 5, an optical sensor 3 for detecting physical or optical features of the bill moving along the passageway 5 to produce detection signals, and a printed circuit board or substrate 4 which supports a controller (not shown) for receiving detection signals from optical sensor 3 to control operation of conveyer 2. As shown in FIGS. 1 and 5, casement 1 comprises a lower case 6 which accommodates a lower optical sensing element 3*a* of optical sensor 3 and other electric and/or electronic elements, and an upper case 10 which accommodates an upper optical sensing element 3*b* of optical sensor 3 and other electric and/or electronic elements. Optical features detected by optical sensor 3 may include optical characteristics of both or either one of trial lights reflected on bill and penetrating bill and then picked up by optical sensor 3.

Figure 3:
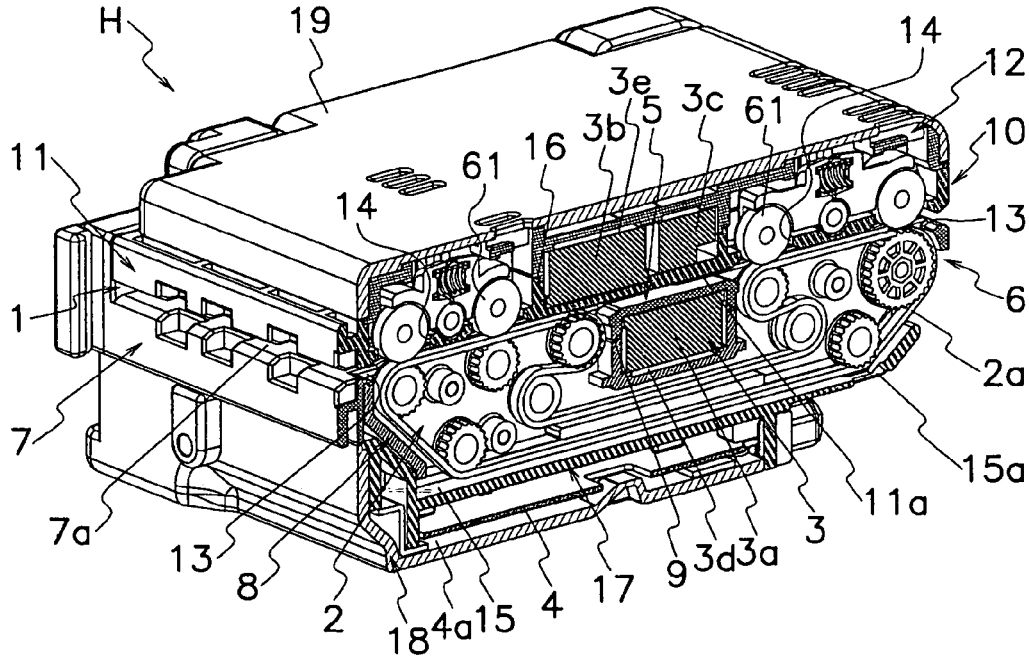
FIG. 3 is a sectional view taken along a line III-III of the discrimination unit shown in FIG. 44.

Optical sensor 3 comprises a lower optical sensing element 3*a* disposed in lower case 6, upper optical sensing element 3*b* and a light receiving element 3*c* both disposed in upper case 10, and if necessary, an optical inlet sensor (not shown) for detecting a bill inserted into passageway 5 and a magnetic sensor (not shown) for detecting a ferrous component contained in ink printed on a surface of bill. Also, as shown in FIGS. 3 and 4, lower optical sensing element 3*a* is disposed within lower case 6, and a controller not shown in the drawings is mounted on substrate 4 which is located in a chamber 4*a* formed between a lower frame 17 and lower casing 18 so that lower and upper optical sensing elements 3*a* and 3*b* are electrically connected to electric and/or electronic elements including the controller all mounted on substrate 4 as necessary. The controller on substrate 4 receives electric signals from optical sensor 3 to forward control output signals to conveyer unit D and stacker unit S and thereby drive conveyer belts 2*a* and other drive mechanisms.

Figure 2:
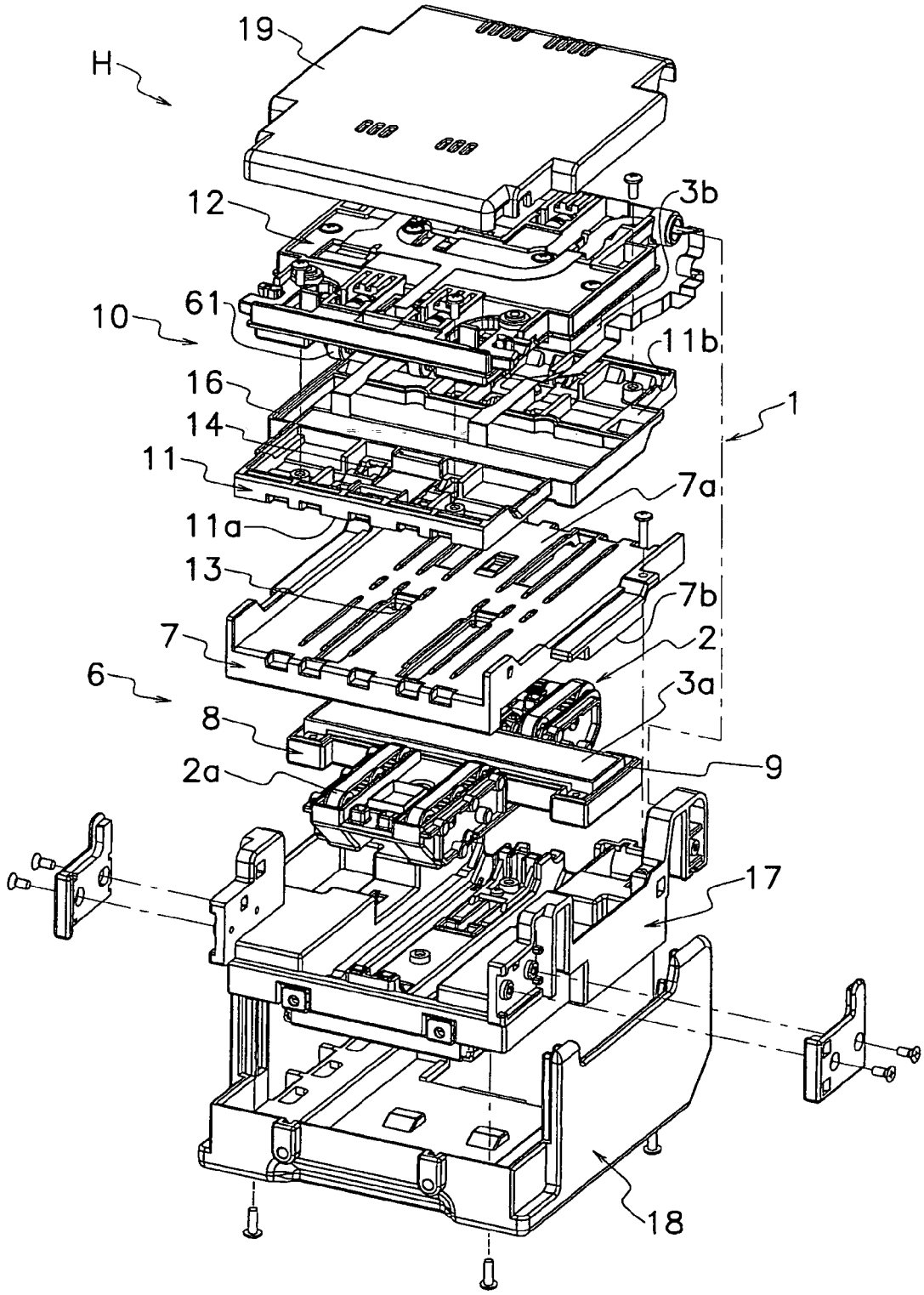
FIG. 2 is an exploded perspective view of a discrimination unit provided in the document handler.
Figure 42:
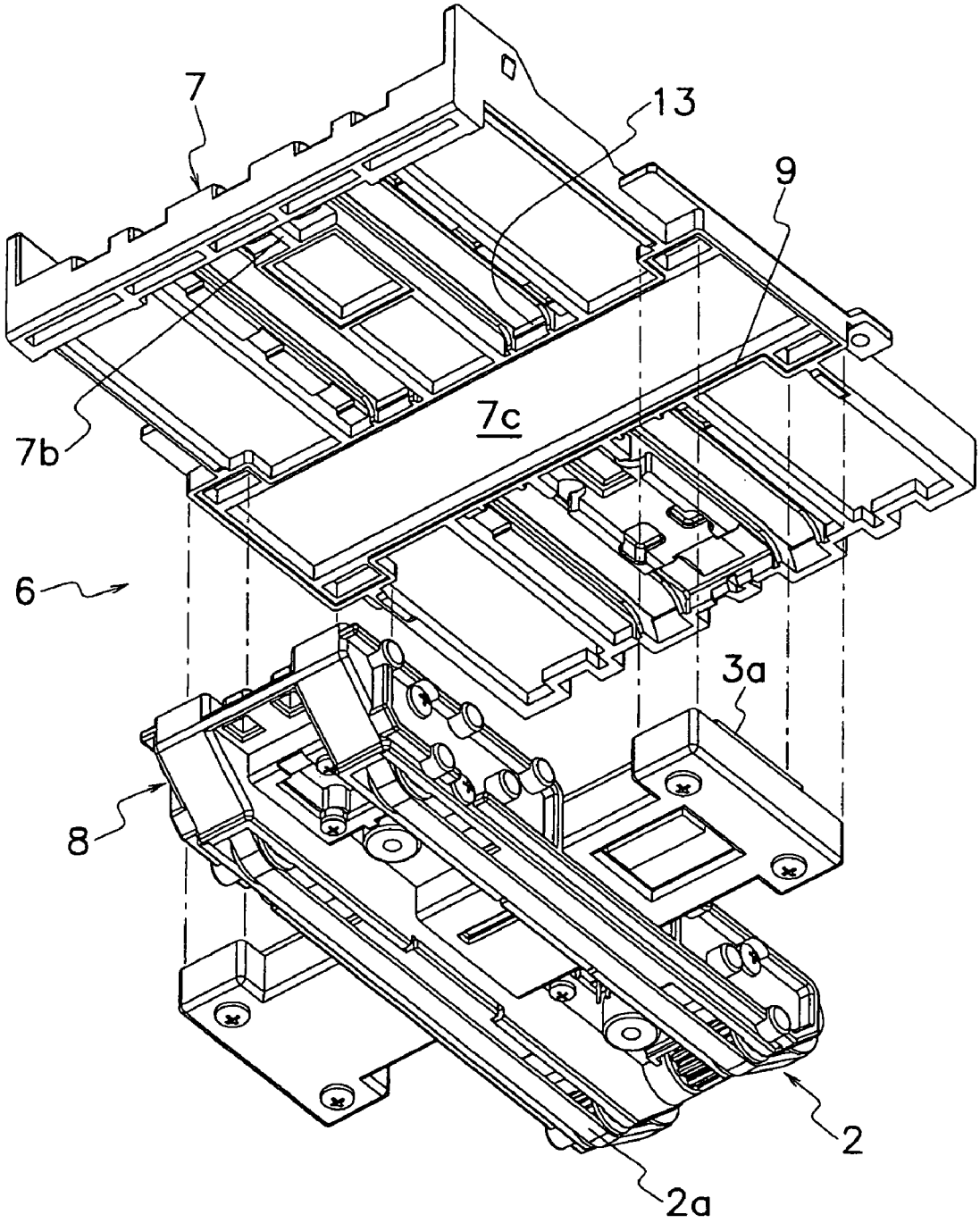
FIG. 42 is an exploded perspective view of a lower case.

As shown in FIGS. 1, 2 and 42, lower case 6 comprises a lower cover 7 formed of a light-permeable and water-shedding plastic material for providing a bottom surface of passageway 5, and a lower tray 8 attached to a bottom of lower cover 7 to form a lower cavity 3*d* between lower cover 7 and lower tray 8 to arrange lower optical sensing element 3*a* of optical sensor 3 within lower cavity 3*d*.

As illustrated in FIGS. 7 to 14, lower cover 7 comprises upper and bottom surfaces 7*a* and 7*b* both of which form a flat guide surface for movement of bill. As seen from FIG. 8, bottom surface 7*b* of lower cover 7 has a lower transparent area 7*c* integrally formed substantially at the center thereof to allow light from lower or upper optical sensing element 3*a* or 3*b* to transmit through lower transparent area 7*c*. As is apparent in FIG. 1, mounted in lower tray 8 are conveyer belts 2*a* of conveyer 2 which are partly arranged in each of four openings 13 formed in lower cover 7 in the condition of conveyer belts 2*a* protruding from opening 13 into passageway 5.

Figure 9:
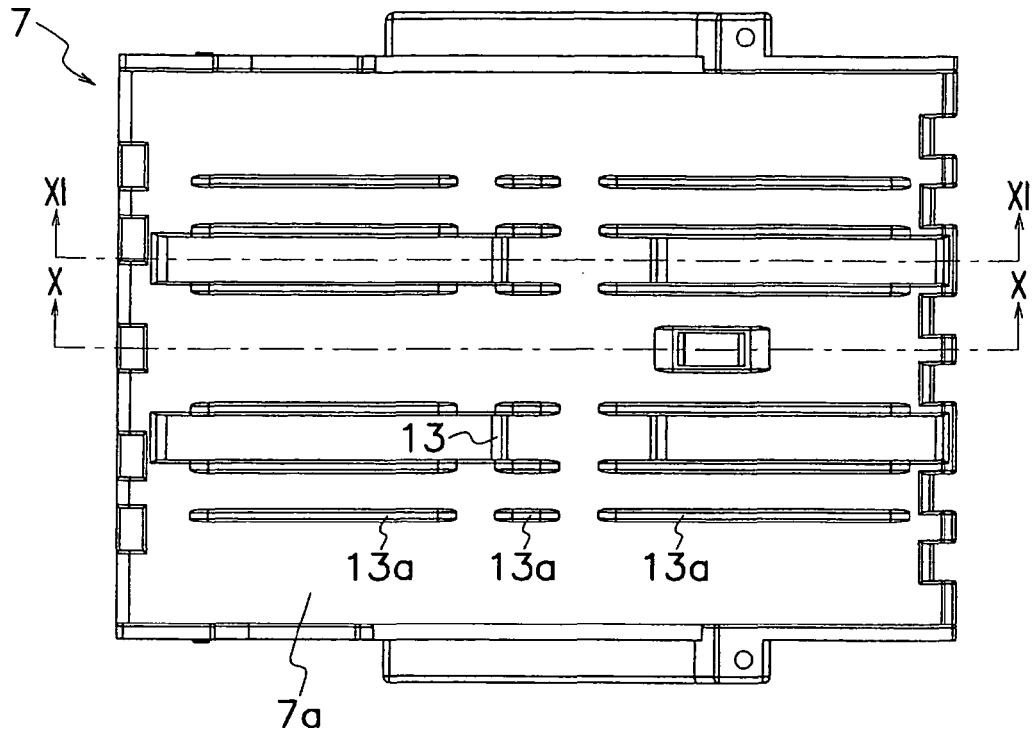
FIG. 9 is a plan view of the lower cover.
Figure 10:
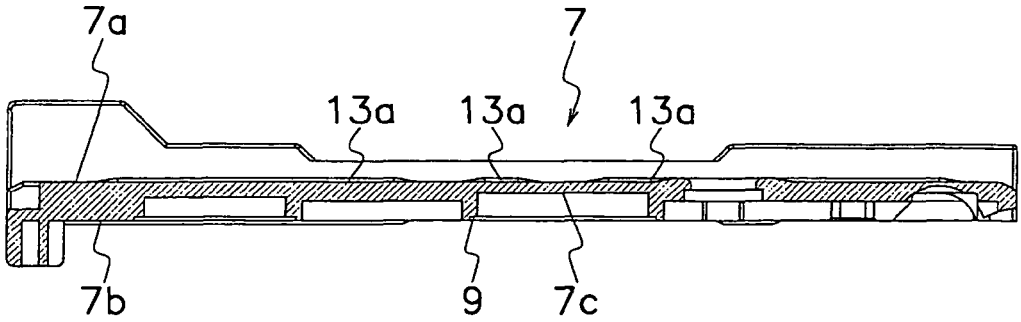
FIG. 10 is a sectional view taken along a line X-X of FIG. 9.
Figure 11:
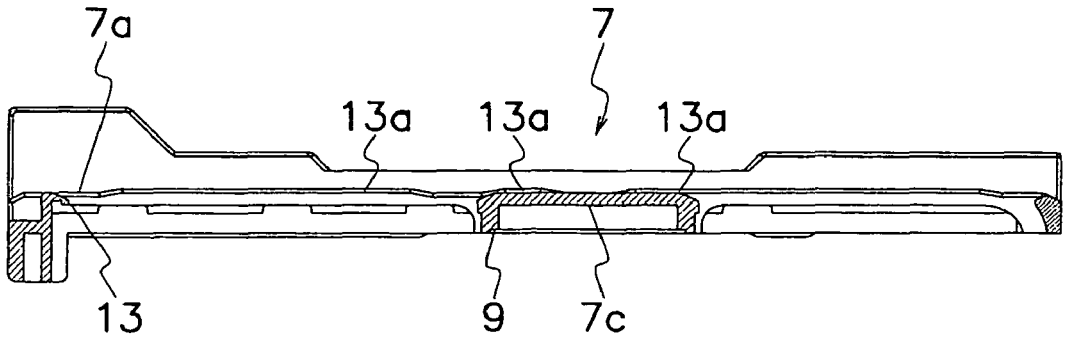
FIG. 11 is a sectional view taken along a line XI-XI of FIG. 9.
Figure 12:
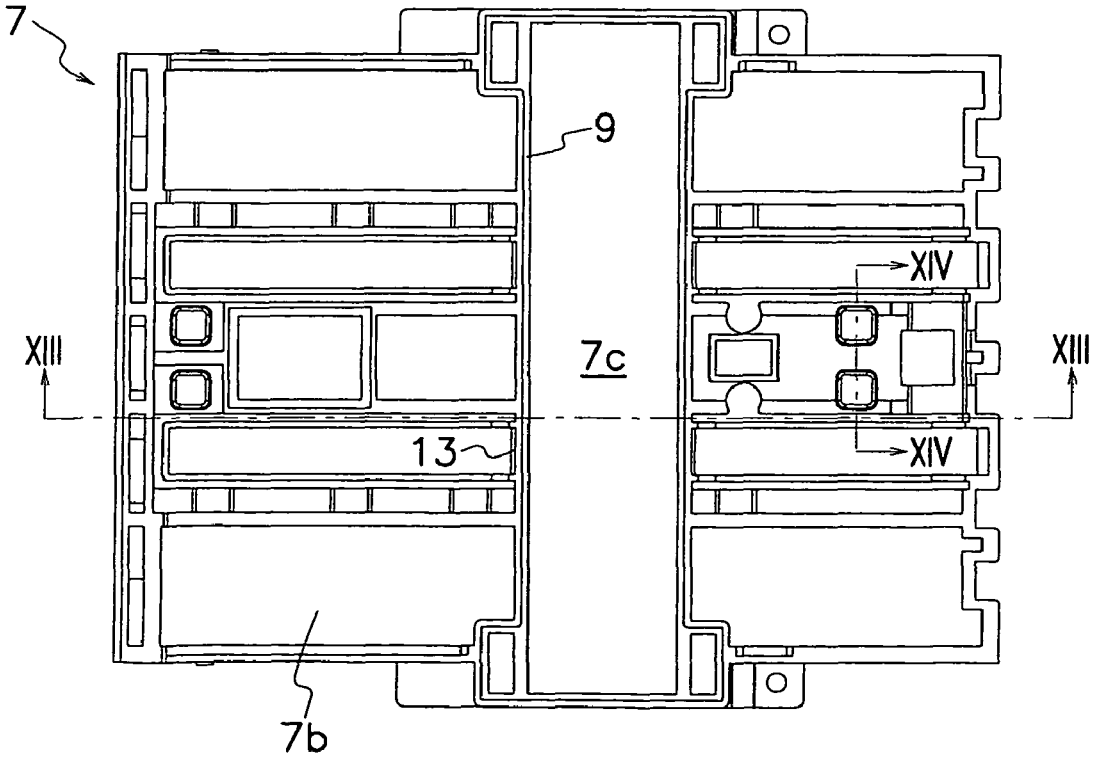
FIG. 12 is a bottom view of the lower cover.
Figure 13:
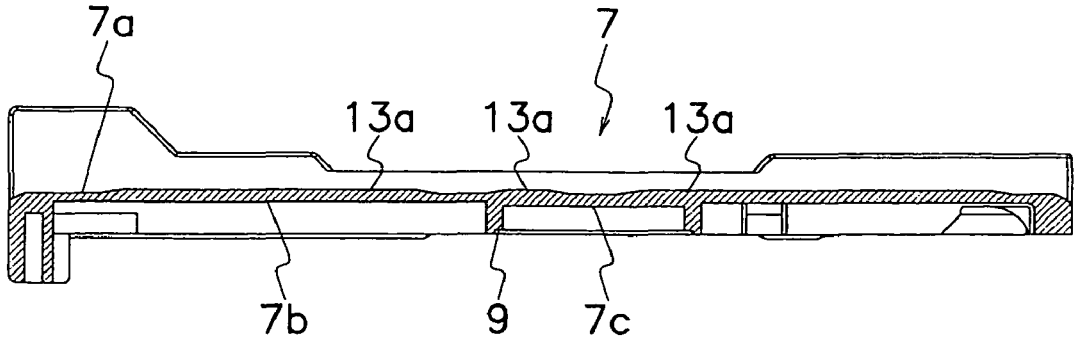
FIG. 13 is a sectional view taken along a line XIII-XIII of FIG. 12.
Figure 14:
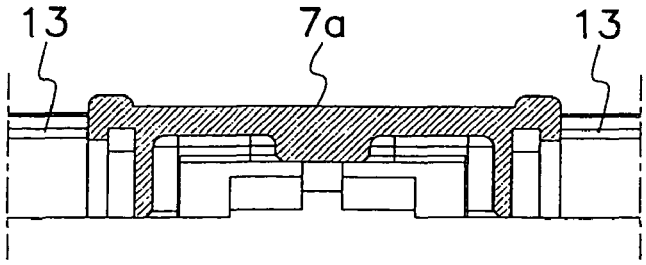
FIG. 14 is a sectional view taken along a line XIV-XIV of FIG. 12.
Figure 15:
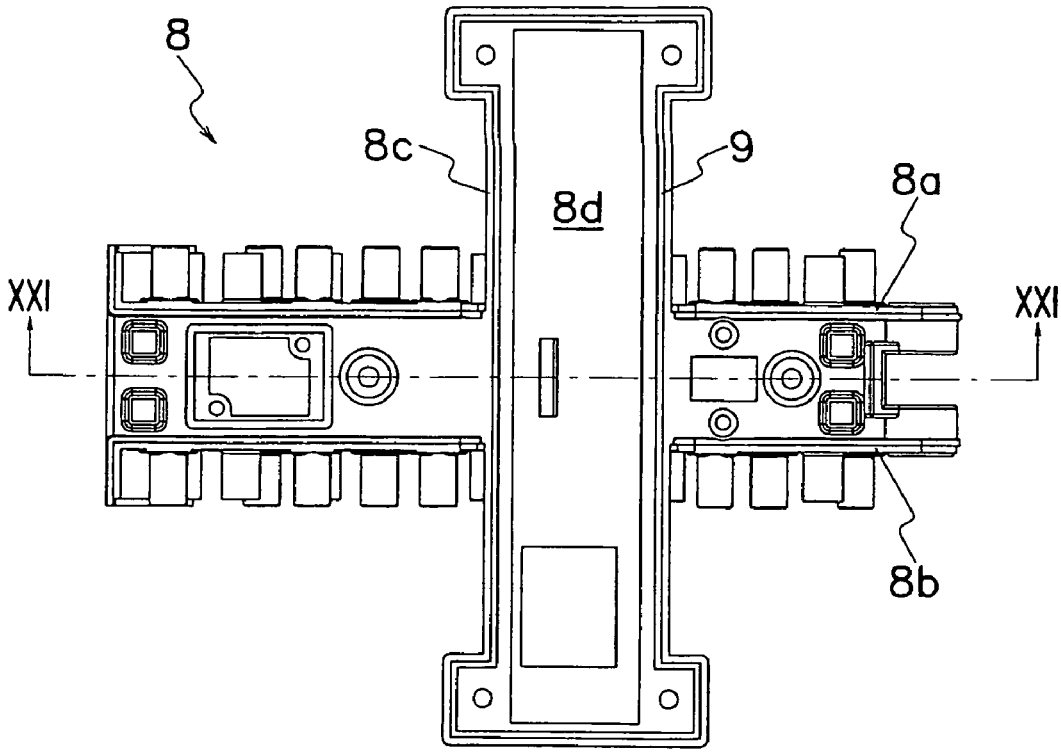
FIG. 15 is a plan view of a lower tray.
Figure 16:
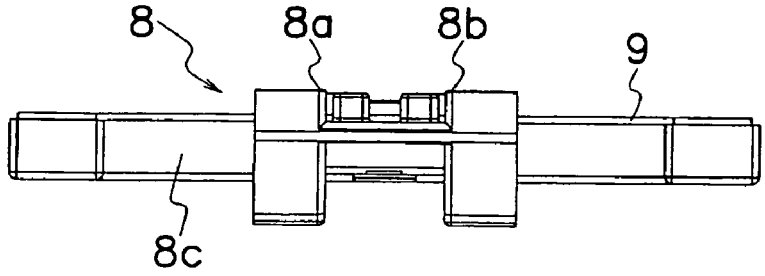
FIG. 16 is a front view of the lower tray.
Figure 17:
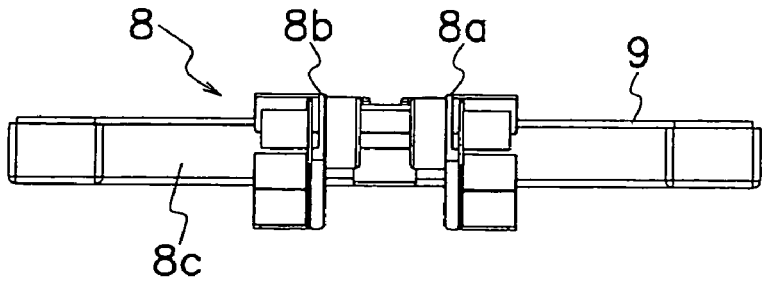
FIG. 17 is a rear view of the lower tray.
Figure 18:
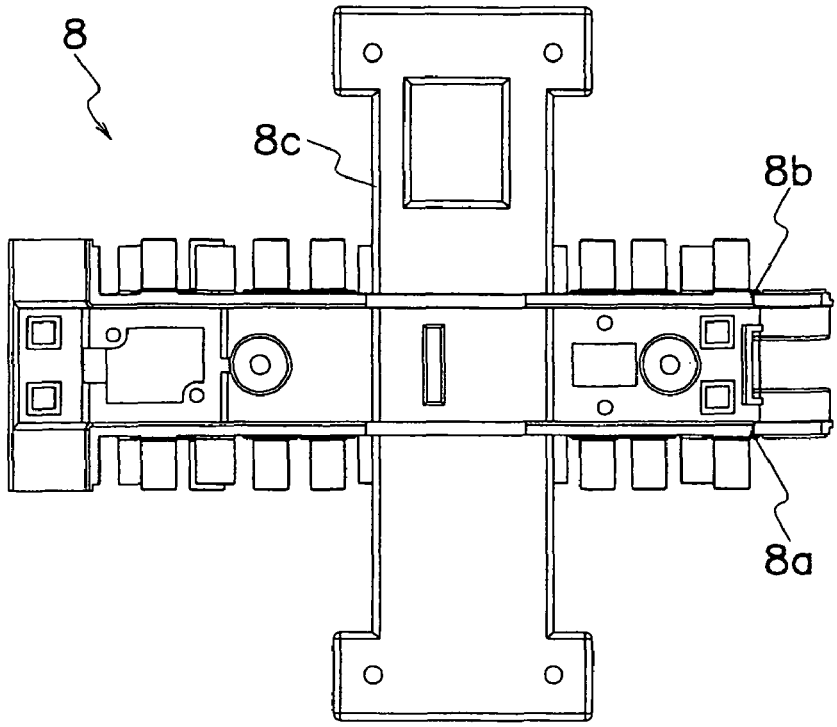
FIG. 18 is a bottom view of the lower tray.
Figure 19:
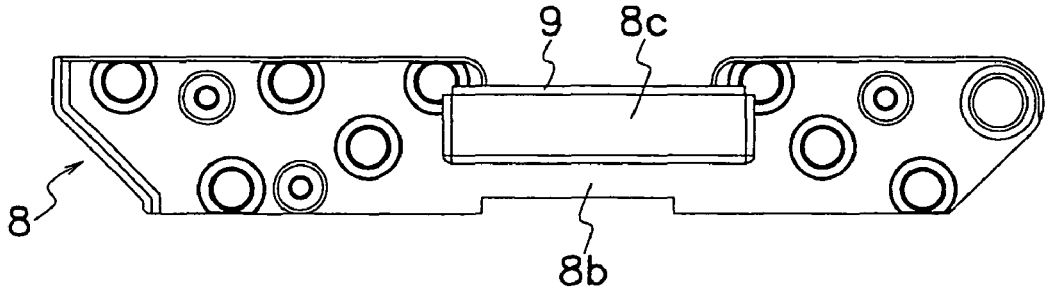
FIG. 19 is a right side elevation view of the lower tray.
Figure 20:
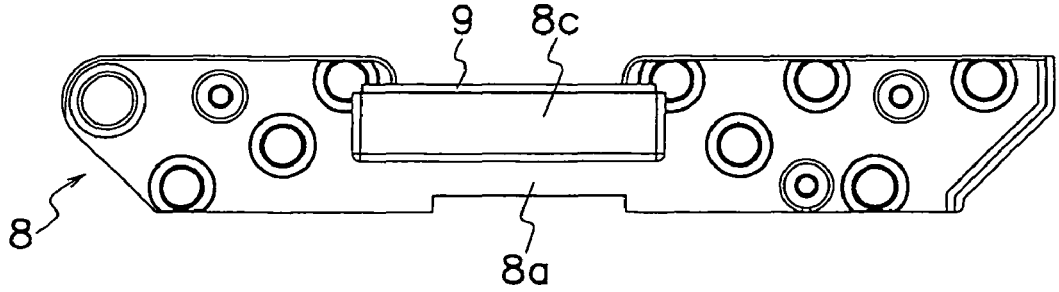
FIG. 20 is a left side elevation view of the lower tray.
Figure 21:
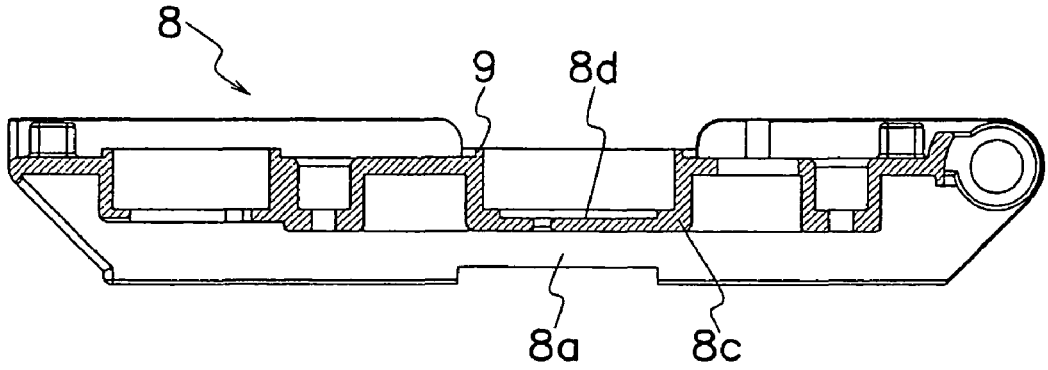
FIG. 21 is a sectional view taken along a line XXI-XXI of FIG. 15.

As is obvious from FIGS. 9 to 11, a plurality of ribs 13*a* may be integrally formed on an upper surface 7*a* of transparent area 7*c* because lower cover 7 may be formed of a light-permeable plastic material. Accordingly, light-permeable ribs 13*a* are penetrated by light from lower optical sensing element 3*a* toward bill or light from bill toward lower optical sensing element 3*a* without deterioration in detected light for accurate validation of bill. Also, ribs 13*a* on lower cover 7 serve to prevent adhesion of traveling bill to upper surface 7*a* for smooth conveyance of bill and to improve mechanical strength of lower cover 7.

Figure 22:
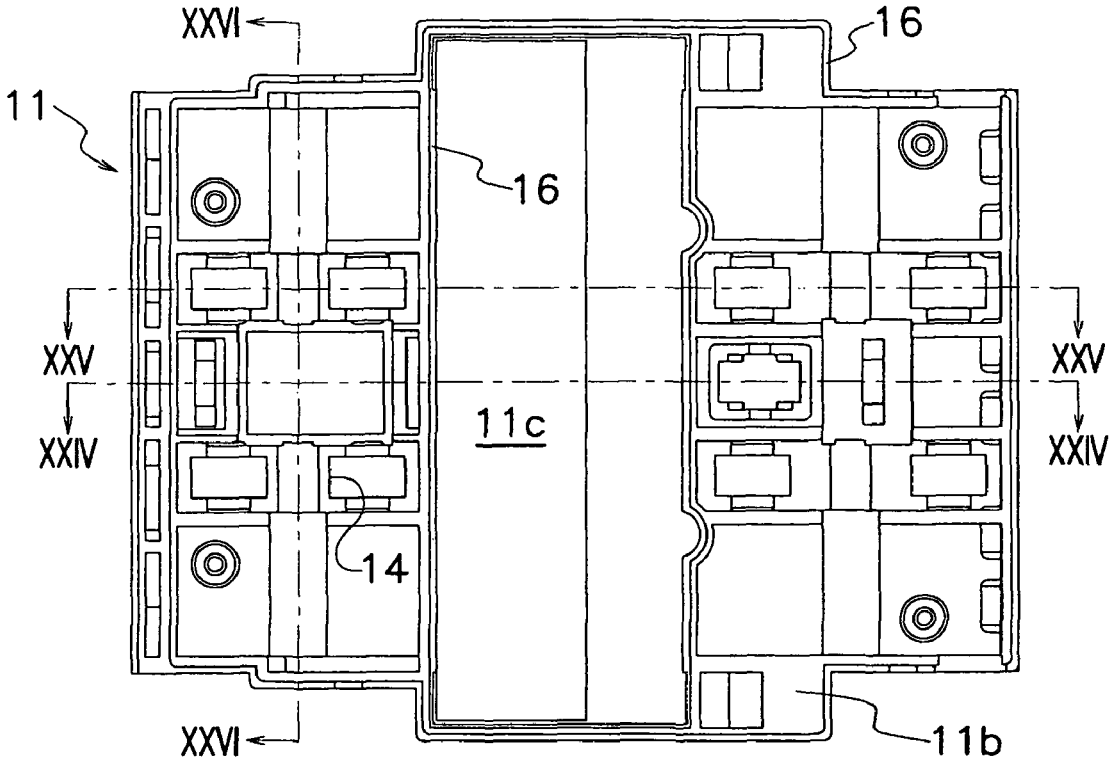
FIG. 22 is a plan view of an upper tray.
Figure 23:
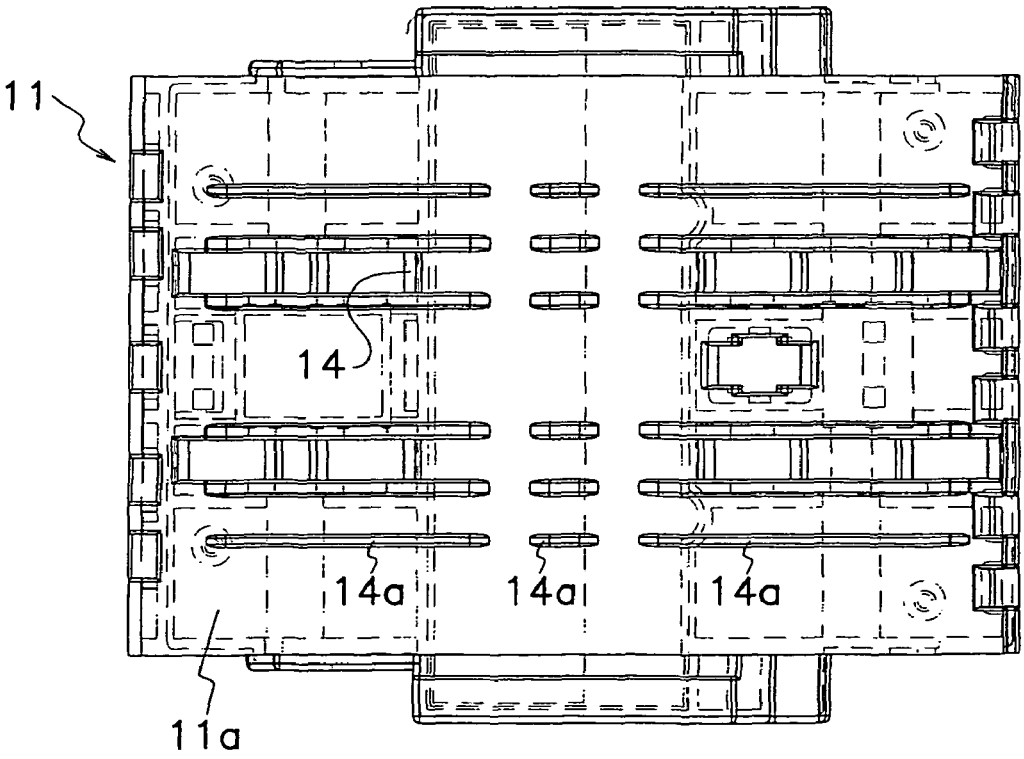
FIG. 23 is a bottom view of the upper tray.
Figure 24:
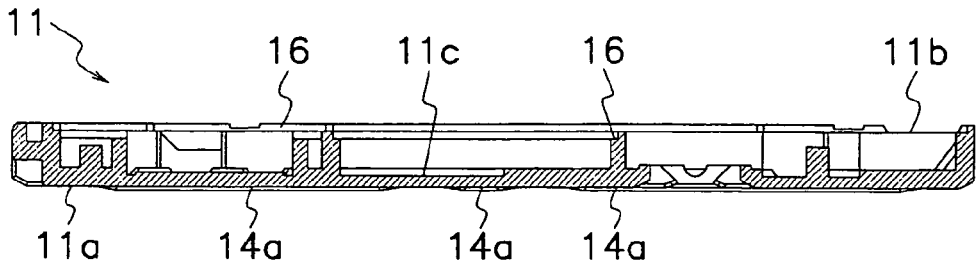
FIG. 24 is a sectional view taken along a line XXIV-XXIV of FIG. 22.
Figure 25:
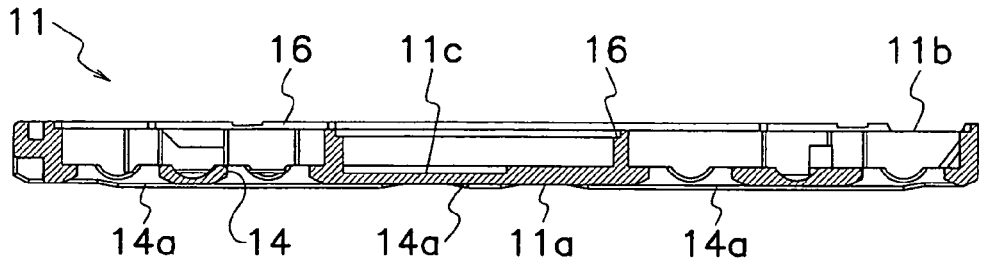
FIG. 25 is a sectional view taken along a line XXV-XXV of FIG. 22.
Figure 26:
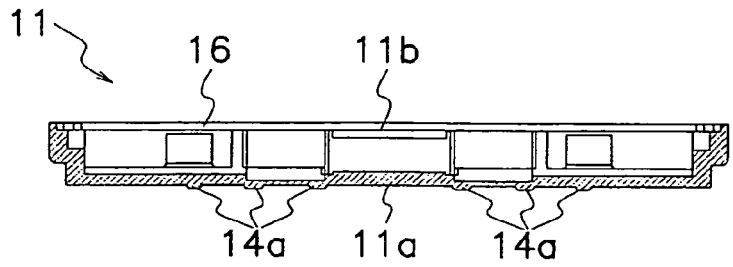
FIG. 26 is a sectional view taken along a line XXVI-XXVI of FIG. 22.
Figure 27:
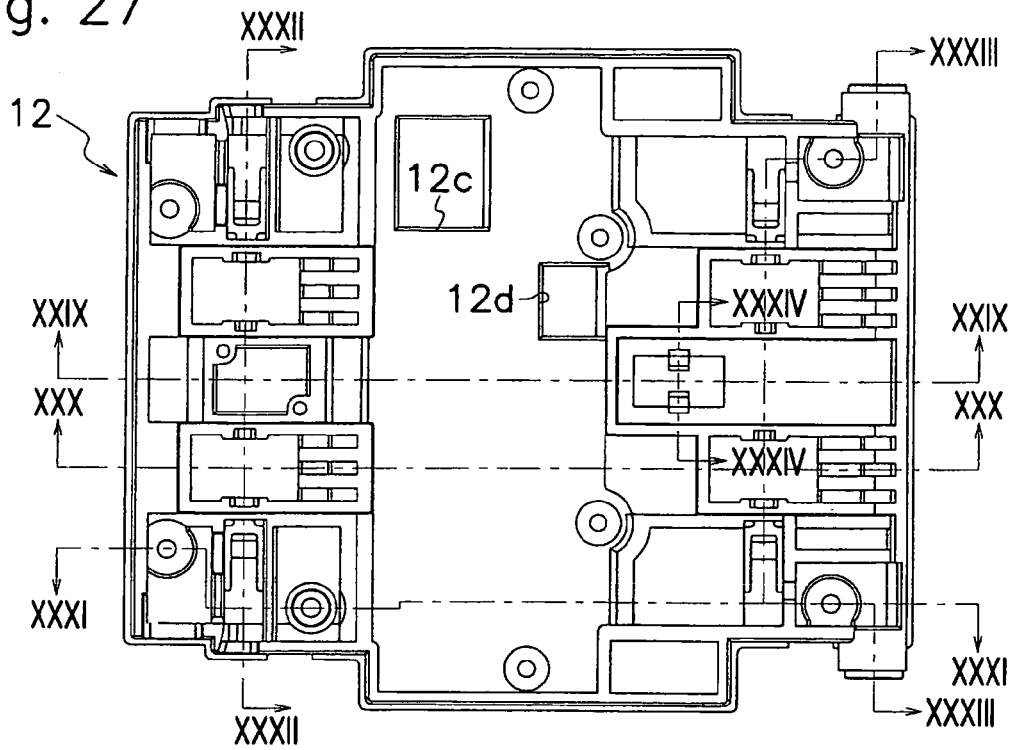
FIG. 27 is a plan view of an upper cover.
Figure 28:
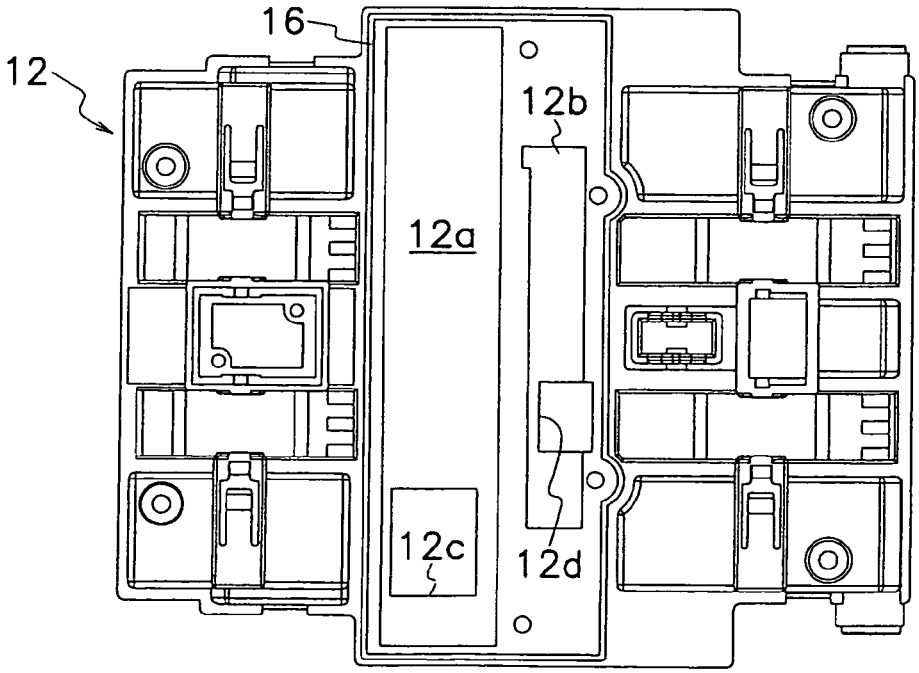
FIG. 28 is a bottom view of the upper cover.
Figure 29:
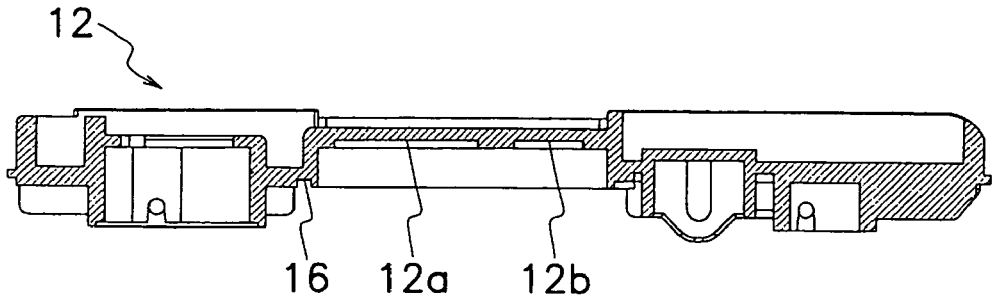
FIG. 29 is a sectional view taken along a line XXIX-XXIX of FIG. 27.
Figure 30:
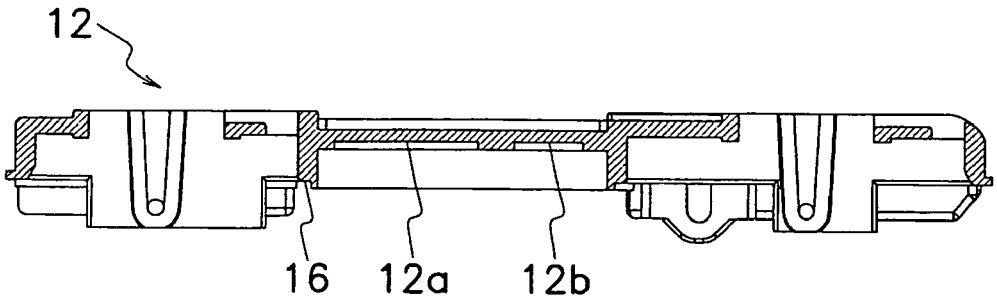
FIG. 30 is a sectional view taken along a line XXX-XXX of FIG. 27.
Figure 31:
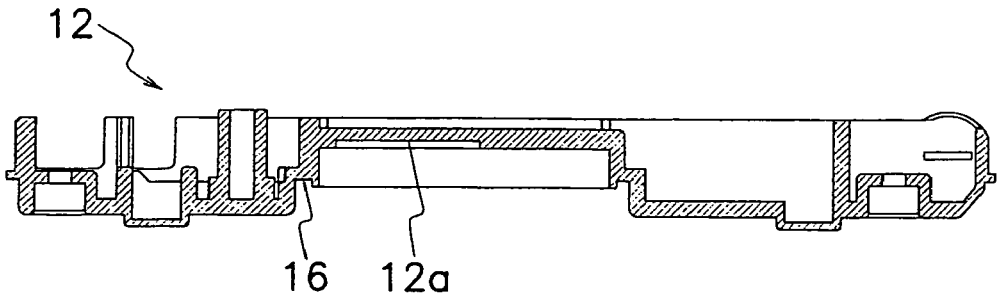
FIG. 31 is a sectional view taken along a line XXXI-XXXI of FIG. 27.
Figure 32:
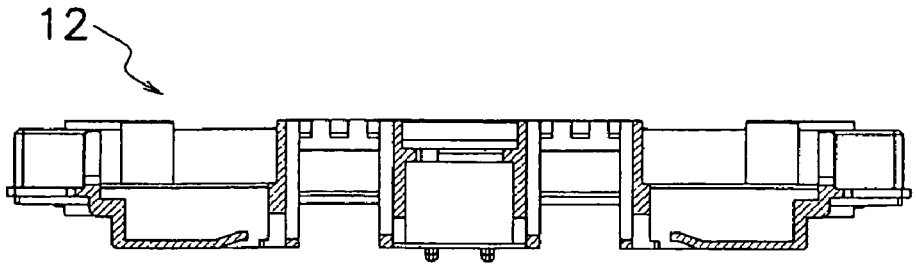
FIG. 32 is a sectional view taken along a line XXXII-XXXII of FIG. 27.
Figure 33:
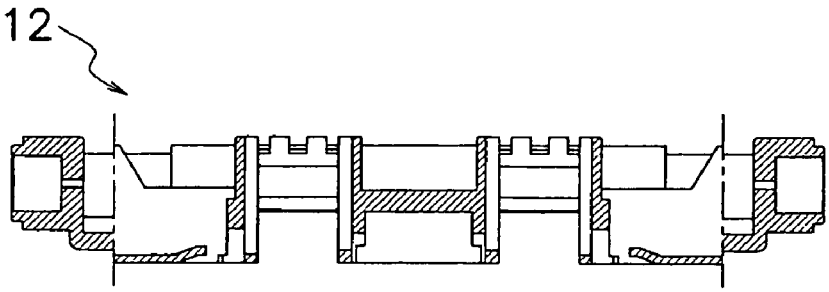
FIG. 33 is a sectional view taken along a line XXXIII-XXXIII of FIG. 27.
Figure 34:
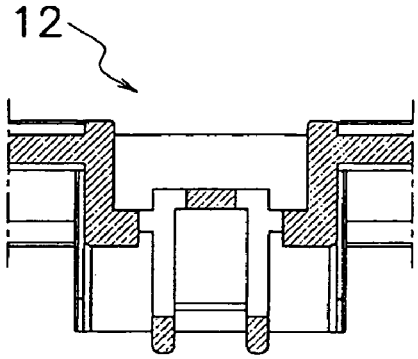
FIG. 34 is a sectional view taken along a line XXXIV-XXXIV of FIG. 27.
Figure 35:
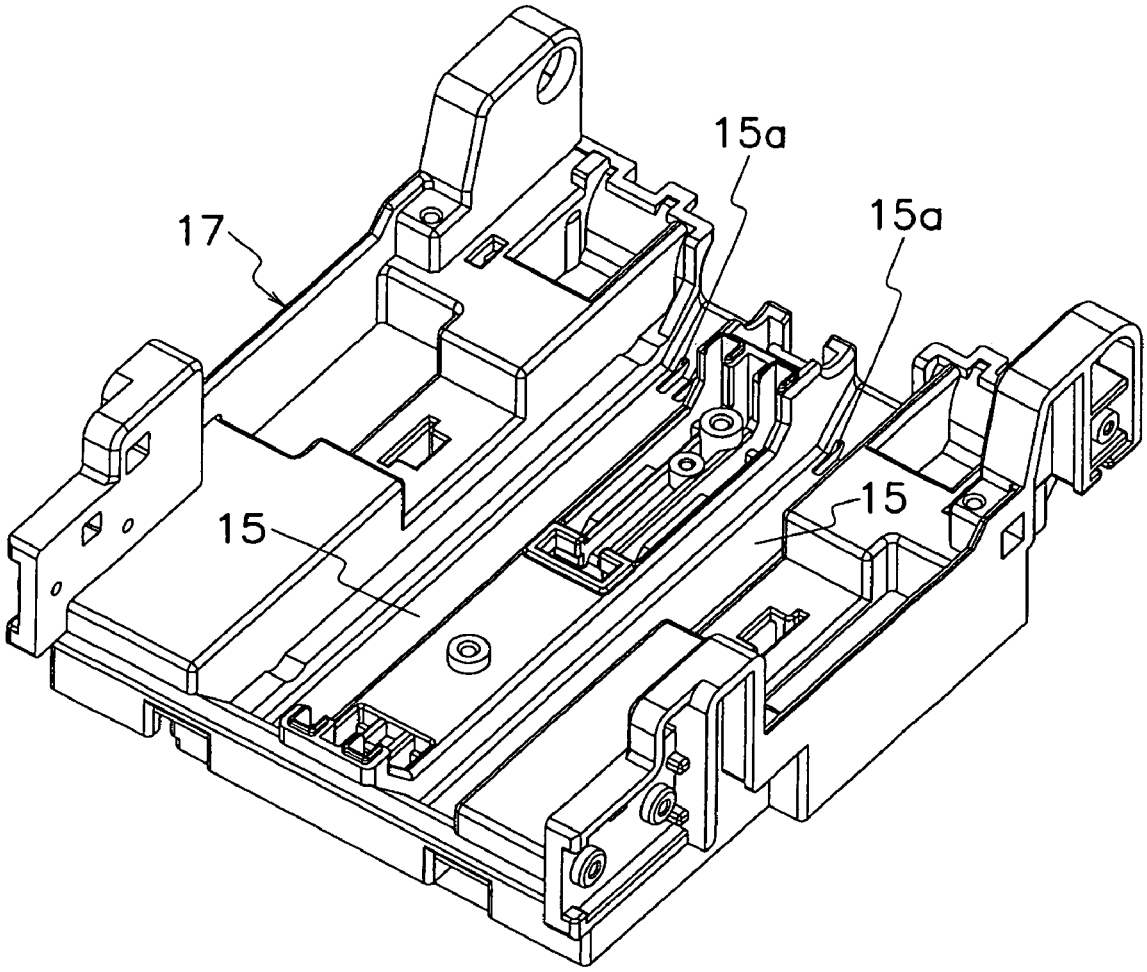
FIG. 35 is a perspective view showing an upper side of a lower frame.
Figure 36:
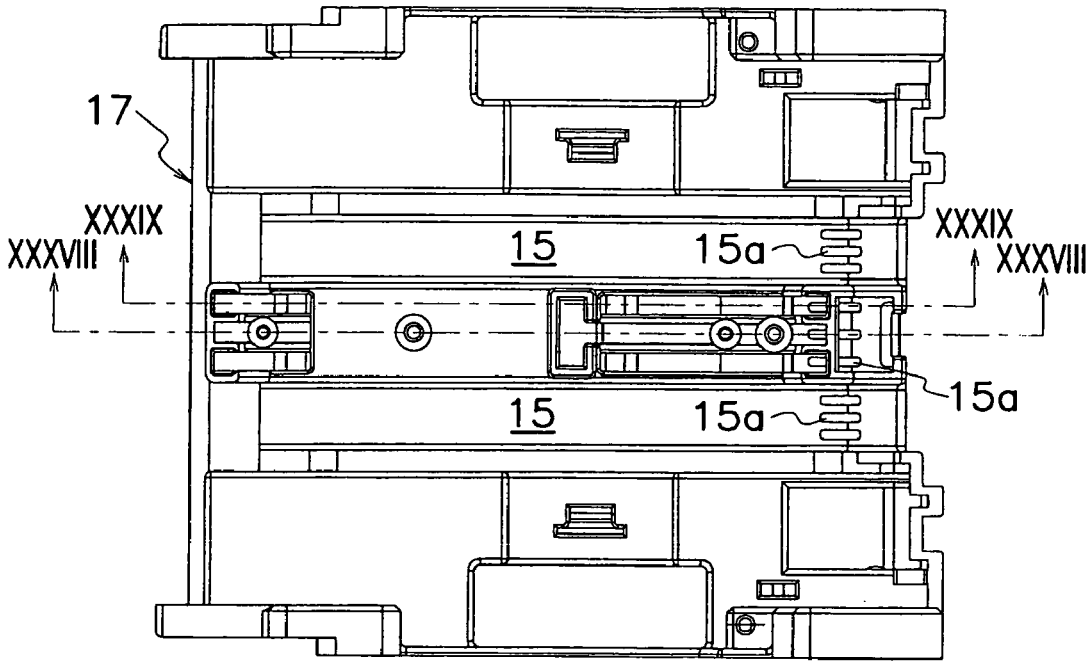
FIG. 36 is a plan view of the lower frame.
Figure 37:
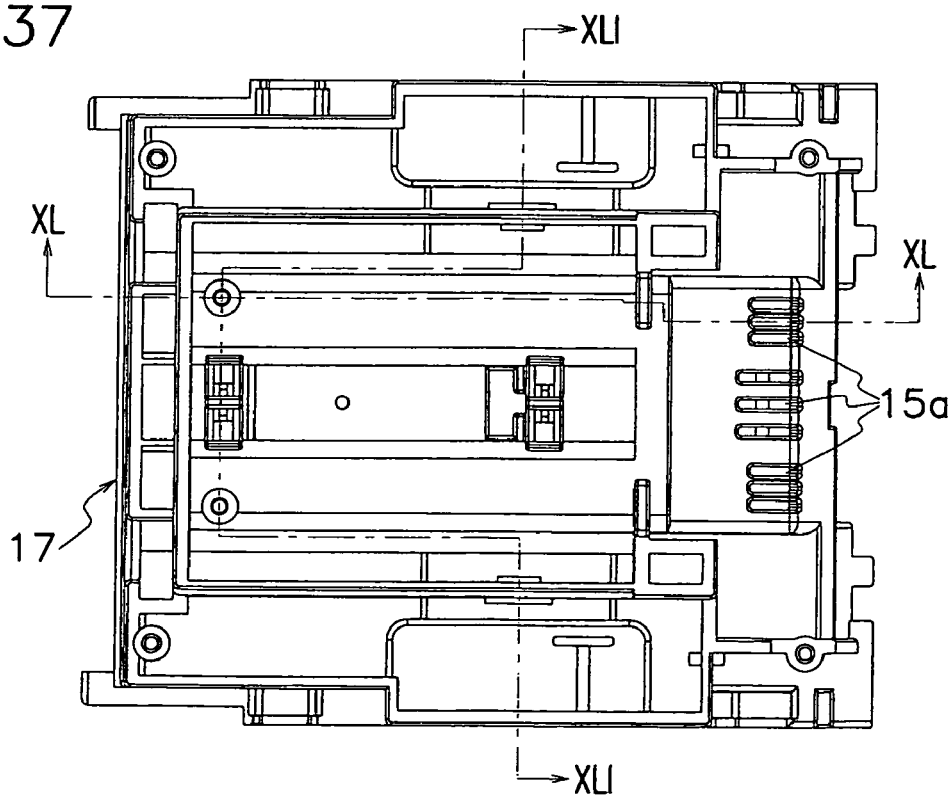
FIG. 37 is a bottom view of the lower frame.
Figure 38:
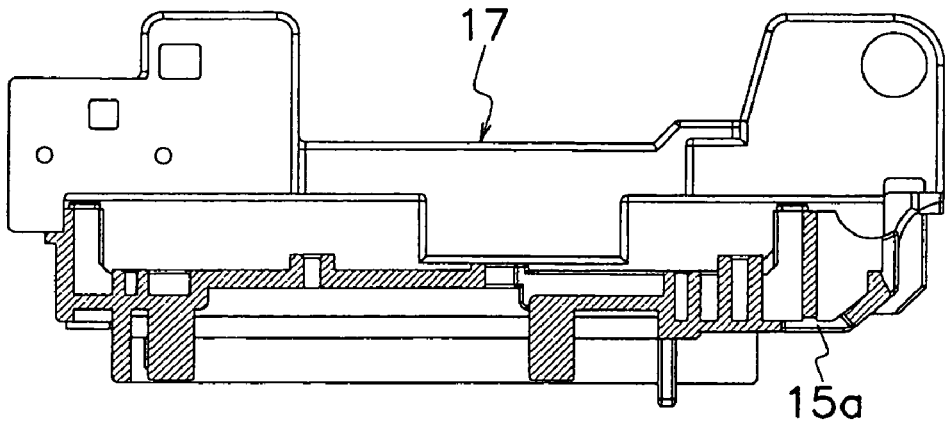
FIG. 38 is a sectional view taken along a line XXXVIII-XXXVIII of FIG. 36.
Figure 39:
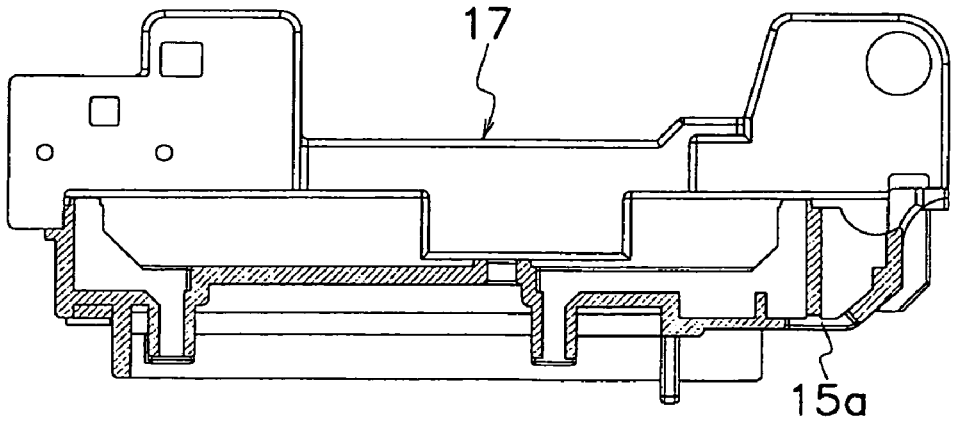
FIG. 39 is a sectional view taken along a line XXXIX-XXXIX of FIG. 36.
Figure 40:
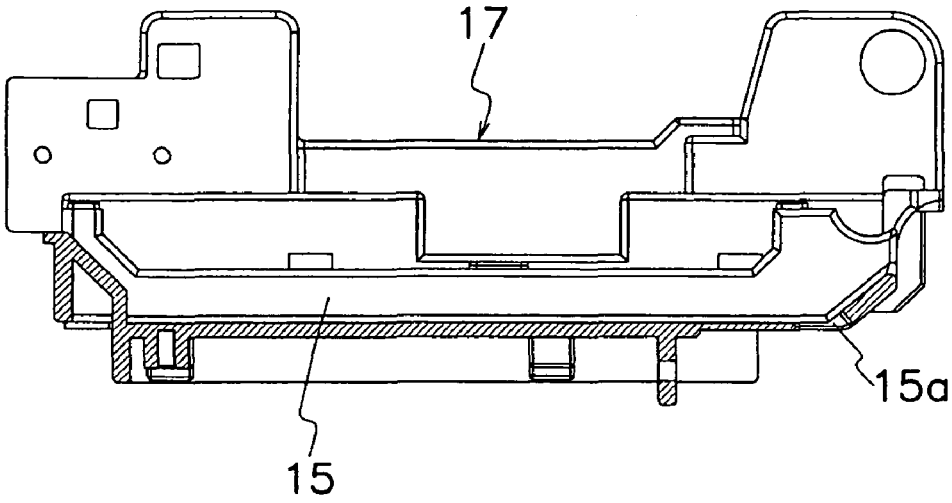
FIG. 40 is a sectional view taken along a line XL-XL of FIG. 37.
Figure 41:
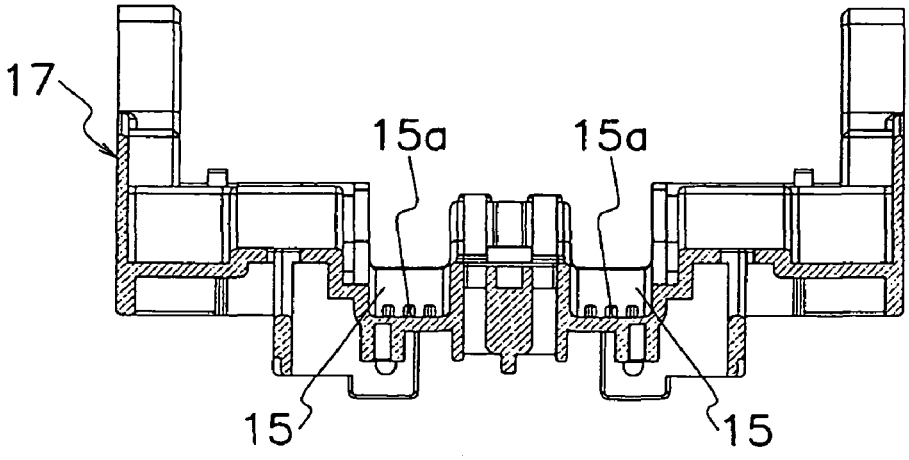
FIG. 41 is a sectional view taken along a line XLI-XLI of FIG. 37.

As is seen from FIGS. 22 to 24, upper tray 11 comprises a bottom surface 11*a* for providing a flat guide surface for bill, and an upper surface 11*b* on the reverse side of bottom surface 11*a*. An upper transparent area 11*c* is formed substantially at the center of upper surface 11*b* to arrange an upper optical sensing element 3*b* and an upper light receiving element 3*c* within upper transparent area 11*c* to convert the transmitted light patterns of bill into electric signals. As well as lower cover 7, upper tray 11 may be formed of a light-permeable plastic material with a plurality of ribs 14*a* on a bottom surface 11*a* within upper transparent area 11*c*. Thus, transparent ribs 14*a* are permeated by light from upper optical sensing element 3*b* toward bill or light from bill toward upper optical sensing element 3*b* for improvement of validation performance.

Figure 43:
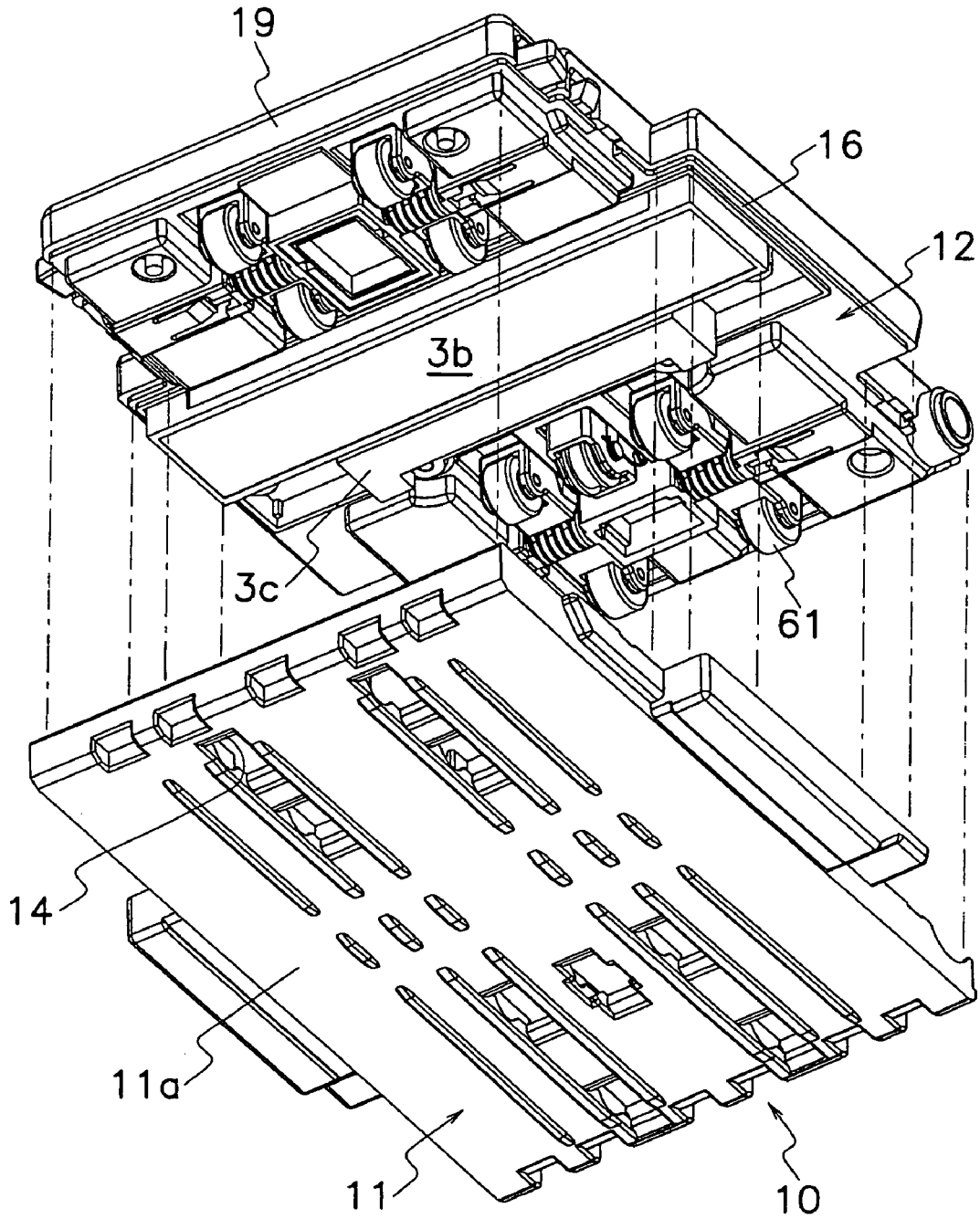
FIG. 43 is an exploded perspective view of an upper case.

Ribs 14*a* serve to prevent adhesion of traveling bill to bottom surface 11*a* for smooth conveyance of bill and to improve mechanical strength of upper tray 11. As shown in FIG. 43, eight pinch rollers 61, which are rotatably mounted on upper cover 12, are arranged within respective eight openings 14 formed in upper tray 11 while each lower periphery of pinch rollers 61 protrudes into passageway 5 to come into contact to conveyer belts 2*a* arranged in lower case 6. Thus, bill is inserted into passageway 5 and grasped between conveyer belts 2*a* and pinch rollers 61 which transport bill along passageway 5.

Upper surface 7*a* of lower cover 7 and bottom surface 11*a* of upper tray 11 provide flat and smooth guide planes for traveling bill along passageway 5. An injection plastic molding process may be used to form lower cover 7 and upper tray 11 whose flat upper surface 7*a* and flat bottom surface 11*a* may be directly used as lower and upper surfaces 5*a* and 5*b* of passageway 5 without further surface treatment of these surfaces 5*a* and 5*b*. To this end, lower cover 7 and upper tray 11 may be formed of a plastic material selected from the group consisting of ABS resin, polycarbonate resin, acrylic resin, polyamide resin, polyacetal resin or any mixture of these resins, and the selected plastic material may have the optical characteristics necessary for lower cover 7 and upper tray 11, and can be selected from various resins optically transparent to for example light wavelength of infrared, ultraviolet, red, green or blue ray.

Same kind or different kinds of resin material may be used to form lower cover 7, lower tray 8, upper cover 12 and upper tray 11. Each optical part of lower cover 7 and upper tray 11 may be formed of light permeable resin or resins to allow light to pass through these optical parts, and the other lightless part of lower cover 7 and upper tray 11 may be formed of an opaque or nontransparent plastic material, and further optical and lightless parts may be integrally molded into a united lower cover 7 or upper tray 11. Otherwise, electrically conductive materials may be mixed in plastic material to render electric conductivity to lower cover 7 and upper tray 11 to form electro-conductive parts so that static electricity that may be charged in lower cover 7 or upper tray 11 due to mechanical friction thereof with bill can be immediately discharged through at least one of the electro-conductive parts. This is very important to certainly prevent jamming of bill and attachment of extraneous substance relative to lower cover 7 or upper tray 11 due to static electricity.

Figure 50:
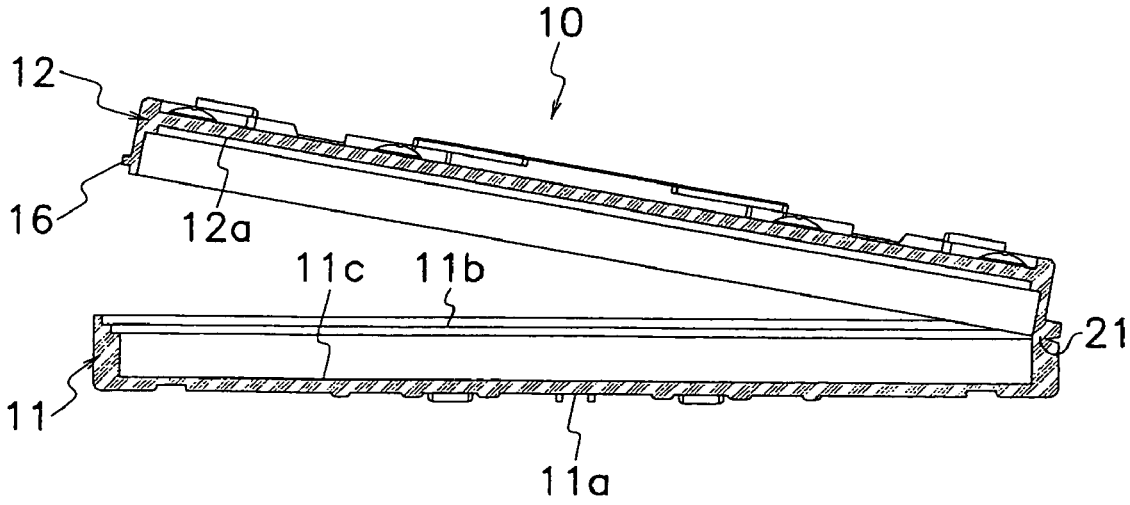
FIG. 50 is a sectional view showing another embodiment of the upper case.

In this case, lower cover 7 and upper tray 11 may selectively have at least one electrically nonconductive part for example facing lower and/or upper optical sensing elements 3*a* and 3*b*. In another aspect, as demonstrated in FIG. 49, lower cover and tray 7 and 8 of lower case 6 may be all integrally formed with a partially thin-walled connector 20 to fold lower case 6 along connector 20 and then superimpose one on top of the other of lower cover and tray 7 and 8. By these operations, formed between lower cover and tray 7 and 8 is lower cavity 3*d* in which lower optical sensing element 3*a* is located while improving the productive efficiency of lower case 6. Likewise, as shown in FIG. 50, upper tray and cover 11 and 12 of upper case 10 may be all integrally formed with a partially thin-walled connector 21 to fold upper case 10 along connector 21 and then superimpose one on top of the other of upper tray and cover 11 and 12 between which formed is upper cavity 3*e* to hold upper optical sensing element 3*b* therein for improvement in the productive efficiency of upper case 10.

Figure 6:
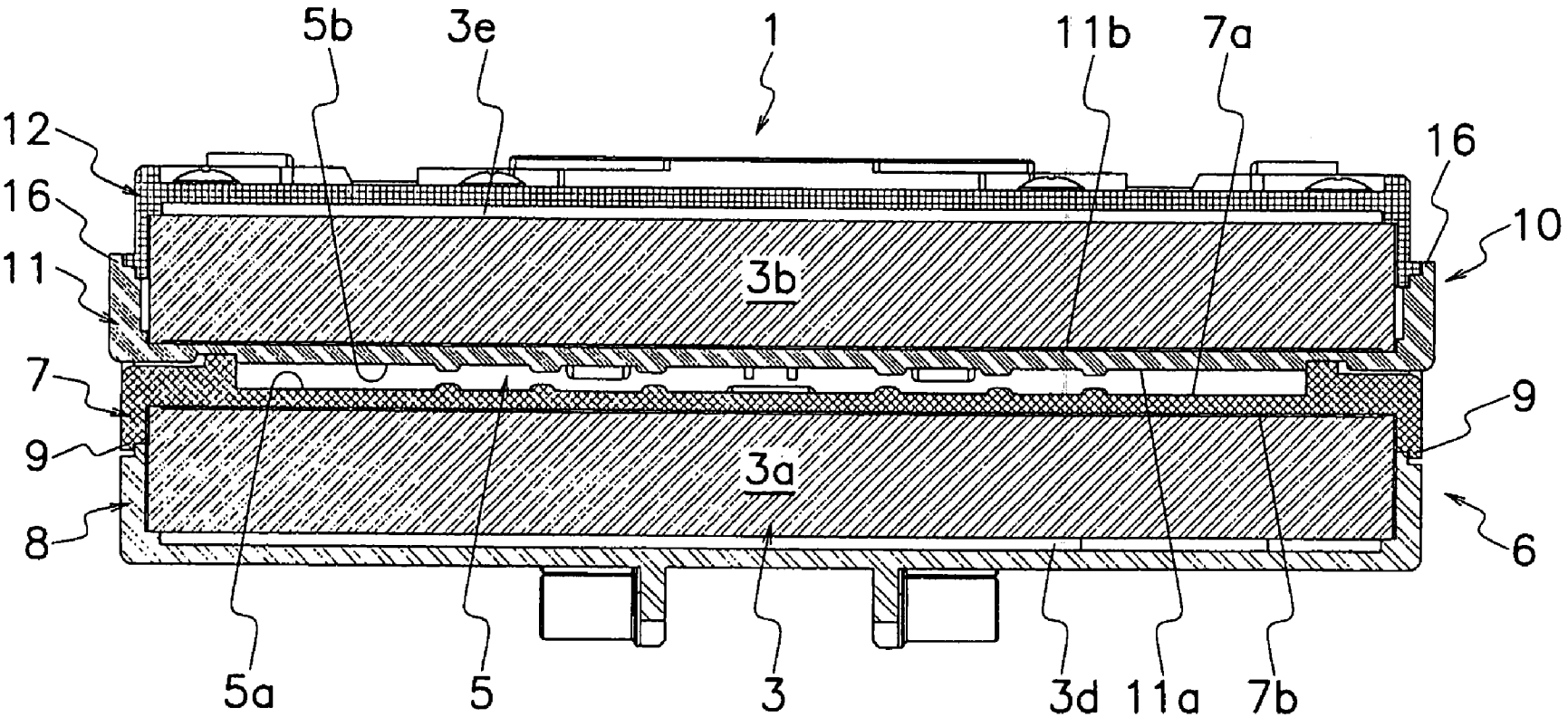
FIG. 6 is a transversely sectional view of the casement.
Figure 7:
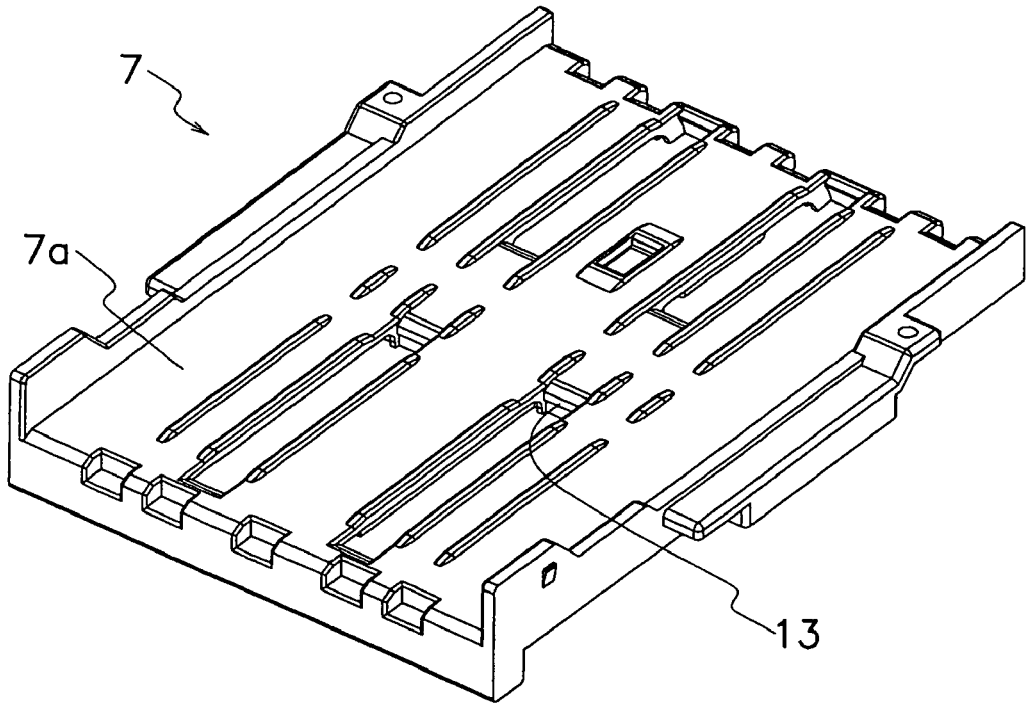
FIG. 7 is a perspective view showing an upper surface of a lower cover.
Figure 8:
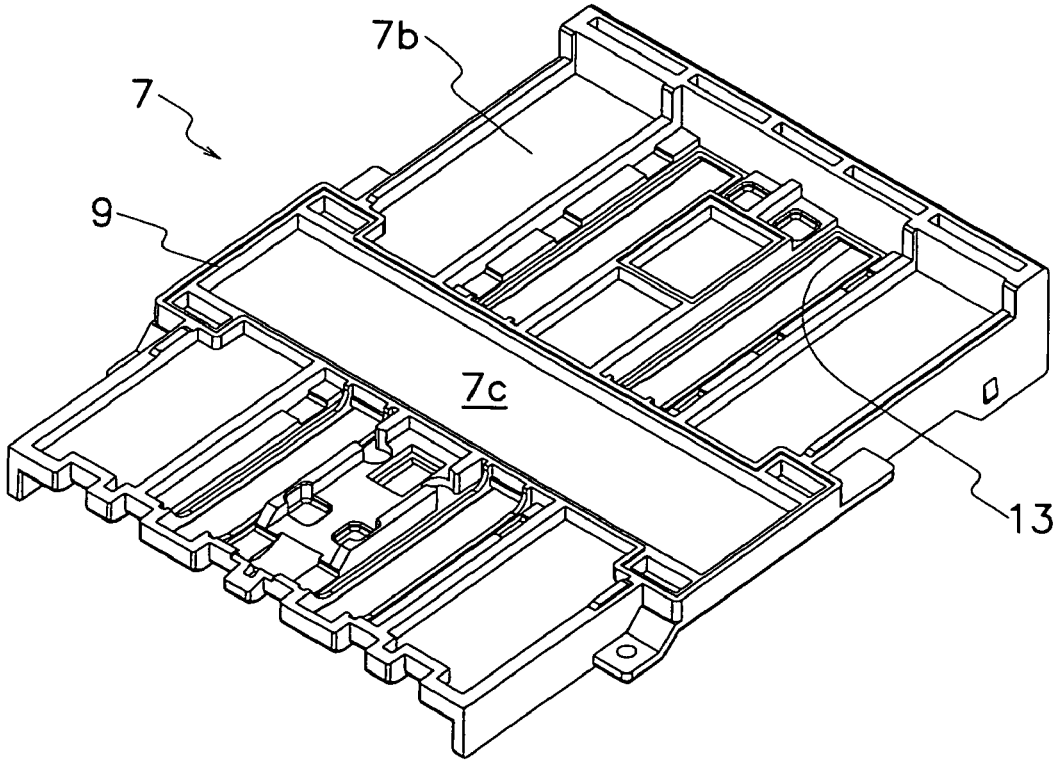
FIG. 8 is a perspective view showing a bottom surface of the lower cover.

As seen from FIG. 6, lower tray 8 is jointed to lower cover 7 through a set-in structure 9 with snug fit, and at least one part of sensor 3 is located within set-in structure 9 to improve the water-proof performance of lower cover 7 against intruding liquid. Set-in structure 9 may be formed into one or more of various structures such as a rectangular or curved convex-concave, concave-convex, stepped and pawl-latch structure without limitation to the shown structure. Lower optical sensing element 3*a* of sensor 3 may incorporate a contact image sensor which comprises for example a plurality of light emitting elements, and a plurality of light receiving elements for receiving lights first radiated from light emitting elements, second passing through lower cover 7, third reflected on bill toward light receiving elements, and finally again passing through lower cover 7 to convert the transmitted light patterns of bill into electric signals. In a similar manner, upper optical sensing element 3*b* of sensor 3 may incorporate a contact image sensor which comprises for example a plurality of light emitting elements, and a plurality of light receiving elements for receiving lights first radiated from light emitting elements, second passing through upper tray 11, third reflected on bill toward light receiving elements, and finally again passing through upper tray 11 to convert the transmitted light patterns of bill into electric signals.

In another embodiment of the invention, light emitting elements of upper optical sensing element 3*b* may radiate lights which move through bottom surface 11*a* of upper tray 11, bill and upper surface 7*a* of lower cover 7 and finally are received by one or more light receiving elements in lower optical sensing element 3*a* to convert the transmitted light patterns of bill into electric signals. Adversely, light emitting elements of lower optical sensing element 3*a* may radiate lights which go through upper surface 7*a* of lower cover 7, bill and bottom surface 11*a* of upper tray 11 and finally are received by one or more light receiving elements in upper optical sensing element 3*b* to convert the transmitted light patterns of bill into electric signals.

If a large amount of extraneous substance such as liquid pours into passageway 5, drainages 15 are formed through four openings 13 in lower cover 7 and eight openings 14 in upper tray 11 to discharge extraneous substance outside through passageway 5. In FIG. 1, bold arrows 51 denote drainages 15 for extraneous substance like liquid through openings 13 in lower cover 7. In this way, foreign matter coming from inlet 5*c* into passageway 5 travels by its own gravity or by any kinetic force through openings 13 or drainages 15, inside of lower case 6 and exits through discharge port 15*a* at the rear of lower case 6. As shown by bold dotted arrows 52 in FIG. 1, a large amount of foreign matter like liquid may also flow through passageway 5, eight openings 14 in upper tray 11 and discharge port 15*a* for exhaustion.

In assembling discrimination unit H, lower optical sensing element 3*a* and other electric/electronic elements are mounted on substrate 4 which is then deployed within lower cavity 3*d* between lower frame 17 and lower casing 18. Thereafter, lower and upper cases 6 and 10 are located between lower and upper casings 18 and 19 in the stacked condition shown in FIG. 2 to complete assemblage of discrimination unit H. Subsequently, as shown in FIG. 46, when discrimination unit H is moved along guide rails 30 on conveyance unit D for engagement of discrimination unit H with conveyance unit D through any known latch means, passageway 5 is automatically connected to an inlet 32 of conveyance unit D. In addition, when stacker unit S is fit into main frame F, bill entrance 40 of stacker unit S is automatically connected to an outlet 33 of conveyance unit D.

In conclusion, the bill handler of the embodiments according to the present invention can achieve the following functions and effects:

(1) As shown in FIG. 1, lower and upper optical sensing elements 3*a* and 3*b* are not subject to damage by liquid or harmful substance coming into passageway 5 because lower and upper optical sensing elements 3*a* and 3*b* are hermetically sealed respectively within lower and upper cavities 3*d* and 3*e* between lower cover and tray 7 and 8 of water-shedding lower case 6 and between upper cover and tray 11 of water-shedding upper case 10.

(2) This can evade damage to lower optical sensing element 3*a* resulted from extraneous substance entering passageway 5 to prevent malfunction and breakdown of the bill handler.

(3) Even if foreign matter such as liquid penetrates inside, it moves downward through openings 13, 14 formed in lower and upper cases 6 and 10 by its own gravity or by any kinetic force and automatically and smoothly exits from discrimination unit H through discharge port 15*a*.

(4) Since electrically operated devices can be accommodated or encapsulated in lower and upper cases 6 and 10, the bill handler can be more easily handled, transported and assembled while well preventing inadvertent short-circuit accidents.

(5) As lower cover 7 of lower case 6 and upper tray 11 of upper case 10 are formed of a transparent plastic material, the bill handler can detect optical characteristics of bill moving through passageway 5 utilizing lights passing through lower cover 7 and upper tray 11 from and received by lower and upper optical sensing elements 3*a* and 3*b* within lower and upper cavities 3*d* and 3*e*.

(6) Since passageway 5 can be defined by flat and smooth surfaces resulted by plastic-molded lower cover 7 and upper tray 11 of lower and upper cases 6 and 10, bill can be favorably transported along passageway 5 without jamming or clogging.

(7) Even if heat is generated during the normal operation of discrimination unit H, it is well radiated by air flow through drainages 15 for originally discharging extraneous substance to prevent overheating of discrimination unit H during its continuous operation.

In the shown embodiments, the document handler is described as having conveyance unit D, main frame F, stacker unit S and discrimination unit H operated therewith, however, the present invention may utilize discrimination unit H only as the document handler. Also, in these embodiments, it is apparent that the present invention is applicable to handle valuable papers such as bank notes, currencies, coupons, scrip, securities, certificates, etc., in lieu of bill.

The present invention is in particular applicable to bill handlers having the water-proof or dust-proof structure.

What is claimed are:

1. A document handler comprising:

a casement for defining a passageway, a conveyer for transporting a document along the passageway, an optical sensor having at least one lower optical sensing element for detecting physical features of the document moving along the passageway to produce detection signals, and a controller for receiving the detection signals from the optical sensor to control operation of the conveyer, wherein the casement comprises a lower case which has a lower cover and a lower tray attached to a bottom of the lower cover to form a lower cavity between the lower cover and lower tray, said lower cover being formed of a light-permeable and water-shedding plastic material for providing a bottom surface of the passageway, the lower optical sensing element of the optical sensor is disposed within the lower cavity.

2. The document handler of claim 1, wherein the lower cover comprises an upper surface which provides a flat guide surface for the moving document.

3. The document handler of claim 1, wherein the lower cover is formed of a plastic material selected from the group consisting of ABS resin, polycarbonate resin, acrylic resin, polyamide resin, polyacetal resin or any mixture of these resins.

4. The document handler of claim 1, wherein the lower cover is electrically conductive.

5. The document handler of claim 1, wherein the lower tray is attached to the lower cover via a set-in structure, the lower optical sensing element of the optical sensor is located inside of the set-in structure.

6. The document handler of claim 5, wherein the set-in structure is at least one of a rectangular or curved convex-concave, concave-convex, stepped and pawl-latch structure for connecting the lower cover and lower tray.

7. The document handler of claim 1, wherein the optical sensor comprises a light emitting element for radiating a light and a light receiving element for receiving the light which is radiated from the light emitting element, passes through the light-permeable lower cover, reflects on a document and again passes through the lower cover in the adverse direction toward the light receiving element.

8. The document handler of claim 1, wherein the lower cover is formed with openings in which belts or rollers of the conveyer are positioned in the condition of the belts or rollers protruding from the openings into the passageway.

9. The document handler of claim 1, further comprising a drainage formed through the lower case to draw off liquid into the passageway.

10. The document handler of claim 9, wherein the drainage has a discharge port formed at the rear portion of the lower case to eject extraneous object in the drainage outside through the discharge port.

11. The document handler of claim 1, wherein the casement comprises an upper case for forming an upper surface of the passageway, the upper case comprises an upper tray formed of a light-permeable and water-shedding plastic material, and an upper cover attached to a top of the upper tray to form an upper cavity between the upper tray and upper cover, the optical sensor comprises an upper optical sensing element disposed within the upper cavity.

12. The document handler of claim 11, wherein the upper tray comprises a bottom surface which provides a flat guide surface for the moving document.

13. The document handler of claim 11, wherein the upper tray is formed of a plastic material selected from the group consisting of ABS resin, polycarbonate resin, acrylic resin, polyamide resin, polyacetal resin or any mixture of these resins.

14. The document handler of claim 11, wherein the upper tray is electrically conductive.

15. The document handler of claim 11, wherein the upper cover is attached to the upper tray via a set-in structure, the upper optical sensing element of the optical sensor is located inside of the set-in structure.

16. The document handler of claim 11, wherein the optical sensor comprises a light emitting element disposed between the lower cover and lower tray for radiating a light and a light receiving element disposed between the upper tray and upper cover for receiving the light which is radiated from the light emitting element, passes through the light-permeable lower cover, a document and upper tray toward the light receiving element.

17. The document handler of claim 11, wherein the optical sensor comprises an upper optical sensing element disposed between the upper tray and upper cover for radiating a light, and a light receiving element for receiving the light which is radiated from the upper optical sensing element, passes through the upper tray, the document and the lower cover toward the light receiving element.

18. The document handler of claim 11, further comprising lower and upper casings for covering the lower case and upper case, and a substrate disposed in a chamber between the lower casing and lower case.

19. The document handler of claim 11, wherein the upper tray is formed with openings in which belts or rollers of the conveyer are positioned in the condition of the belts or rollers protruding from the opening into the passageway.

20. The document handler of claim 1, wherein the lower case comprises the lower cover and lower tray which are integrally formed of a plastic material with a partially thin-walled connector, the lower case is folded along the connector to superimpose one on top of the other of the lower cover and lower tray to form the lower cavity where a part of the sensor is housed.

21. The document handler of claim 11, wherein the upper case comprises the upper tray and upper cover which are integrally formed of a plastic material with a thin-walled connector, the upper case is folded around the connector to superimpose one on top of the other of the upper tray and upper cover to form the upper cavity where the upper optical sensing element of the sensor is housed.

22. A document handler comprising:

a casement for defining a passageway, a conveyer for transporting a document along the passageway, an optical sensor for detecting physical features of the document moving along the passageway to produce detection signals, and a controller for receiving the detection signals from the optical sensor to control operation of the conveyer, wherein the casement comprises lower and upper cases, the lower case has a lower cover formed of a light-permeable and water-shedding plastic material for providing a bottom surface of the passageway, and a lower tray attached to a bottom of the lower cover to form a lower cavity between the lower cover and lower tray, the upper case has an upper tray formed of a light-permeable and water-shedding plastic material, and an upper cover attached to a top of the upper tray to form an upper cavity between the upper tray and upper cover, the optical sensor comprises a lower optical sensing element disposed within the lower cavity, and an upper optical sensing element disposed within the upper cavity, the passageway is formed between the lower cover of the lower case and upper tray of the upper case.

23. The document handler of claim 22, wherein the lower cover and upper tray are formed with openings in which belts or rollers of the conveyer are positioned in the condition of the belts or rollers protruding from the opening into the passageway.

* * * * *